US009267182B2

(12) United States Patent
Soerensen et al.

(10) Patent No.: US 9,267,182 B2
(45) Date of Patent: Feb. 23, 2016

(54) DEHAIRING OF SKINS AND HIDES

(75) Inventors: Niels Henrik Soerensen, Skaevinge (DK); Tine Hoff, Holte (DK); Peter Rahbek Oestergaard, Virum (DK); Pierre Cassland, Vellinge (SE)

(73) Assignee: NOVOZYMES A/S, Bagsvaerd (DK)

( * ) Notice: Subject to any disclaimer, the term of this patent is extended or adjusted under 35 U.S.C. 154(b) by 148 days.

(21) Appl. No.: 13/702,567

(22) PCT Filed: Jun. 22, 2011

(86) PCT No.: PCT/EO2011/060395

§ 371 (c)(1),
(2), (4) Date: Jan. 7, 2013

(87) PCT Pub. No.: WO2011/161135

PCT Pub. Date: Dec. 29, 2011

(65) Prior Publication Data

US 2013/0102058 A1 Apr. 25, 2013

Related U.S. Application Data

(60) Provisional application No. 61/357,576, filed on Jun. 23, 2010.

(30) Foreign Application Priority Data

Jun. 22, 2010 (EP) ..... 10166873

(51) Int. Cl.
*C14C 1/06* (2006.01)

(52) U.S. Cl.
CPC ..... *C14C 1/065* (2013.01)

(58) Field of Classification Search
CPC ..... A01K 15/026; A23K 1/1853; C12C 1/065
See application file for complete search history.

(56) References Cited

U.S. PATENT DOCUMENTS

| | | | |
|---|---|---|---|
| 3,840,433 | A | 10/1974 | Aunstrup et al. |
| 4,266,031 | A | 5/1981 | Tang et al. |
| 4,636,222 | A | 1/1987 | Pfleiderer et al. |
| 5,834,299 | A | 11/1998 | Andersen |
| 2004/0006825 | A1 | 1/2004 | Rose et al. |
| 2008/0275140 | A1 | 11/2008 | Babel et al. |

FOREIGN PATENT DOCUMENTS

| | | | |
|---|---|---|---|
| EP | 0 482 879 | A2 | 4/1992 |
| WO | 91/13554 | A1 | 9/1991 |
| WO | 94/06942 | A1 | 3/1994 |
| WO | 2008/093353 | A1 | 8/2008 |

OTHER PUBLICATIONS

Rey M.W. et al., Complete genome sequence of the industrial bacterium *Bacillus licheniformis* and comparisons with closely related *Bacillus* species, Genome Biology, Sep. 13, 2004, vol. 5, issue 10, pp. R77-1-R77.12.*
Choudhary R.B. et al., Enzyme technology applications in leather processing, Indian Journal of Chemical Technology, 2004, vol. 11, pp. 659-671.*
Kakudo S. et al., Purification, Characterization Cloning and Expression of a Glutamic Acid-specific Protease from Bacillus licheniformis ATCC 14580, Journal of Biological Chemistry, 1992, vol. 267, No. 33, pp. 23782-23788.*
Carmona and Gray, Nucleic Acid Research, vol. 15, p. 6757 (1987).
Thanikaivelan et al, Trends in Biotechnology, vol. 22, pp. 181-187 (2004).
Uhlig et al., Industrial Enzymes, pp. 351-368 (1998).

* cited by examiner

*Primary Examiner* — Satyendra K Singh
(74) *Attorney, Agent, or Firm* — Elias Lambiris

(57) ABSTRACT

The present invention relates to a method for the processing of hides or skins into leather, comprising enzymatic treatment of the hide or skin with carbohydrase in the soaking step. The present invention can achieve optimal fiber opening results in a relatively short period of time and at the same time does not cause loose grain, and meanwhile the pollution or impact on the environment is reduced in a maximum way.

15 Claims, No Drawings

DEHAIRING OF SKINS AND HIDES

CROSS-REFERENCE TO RELATED APPLICATIONS

This application is a 35 U.S.C. 371 national application of PCT/EP2011/060395 filed Jun. 22, 2011, which claims priority or the benefit under 35 U.S.C. 119 of European application no. 10166873.9 filed Jun. 22, 2010 and U.S. provisional application No. 61/357,576 filed Jun. 23, 2010 the contents of which are fully incorporated herein by reference.

REFERENCE TO A SEQUENCE LISTING

This application contains a Sequence Listing in computer readable form. The computer readable form is incorporated herein by reference.

FIELD OF THE INVENTION

The present invention relates to a method for loosening hairs on hides and skins using a glutamyl endopeptidase. Furthermore, it relates to a faster and more environmental friendly beamhouse process.

BACKGROUND OF THE INVENTION

The traditional beamhouse processes or wet processing cleans the hides or skins and prepare them for further processing like retanning, fat liquoring, dyeing and finishing. The beamhouse process includes the steps of soaking (dirt removal and re-hydration), dehairing (removal of hair, traditionally part of the liming process), liming (removal of hair and release of fats and proteins as well as swelling of the collagen structure), fleshing (removal of fatty tissue), splitting (horizontal cutting into grain split and flesh split), deliming (releasing lime and reducing pH), bating (removal of proteins, scut removal and fiber opening), and pickling (lowering of pH value to around 3) and tanning (stabilization of the skin or hide matrix). The product of this process is generally known as wet-blue.

Enzymes have been used in the leather industry for around 100 years (Uhlig, Chapter 5.9 in Industrial Enzymes and their application 1998 by John Weiley & Sons). At present, enzymes are being used with relative success in soaking, dehairing, bating and degreasing (Thanikaivelan et al, 2004, Trend in Biotechnology 22, 181-187).

Proper removal of hair from the outer surface and the hair follicles is very important to ensure soft and smooth surface of the grain and to ensure evenness in color of the leather. The most commonly practiced method of dehairing of hides and skins is the chemical process using lime and sodium sulphide. It is estimated that less than 2% of the beamhouses use enzymes for dehairing. The sulphide primarily acts by cleaving the disulfide links of the keratin molecules. This action is aided by calcium hydroxide (lime), which loosens the collagen structure through swelling and releases interfibrillar noncollagenous proteins. This process is the conventional hair-burn or pulping system.

Enzymatic dehairing methods are known as an environmentally-friendly alternative to the conventional chemical process. Examples of enzymatic dehairing are described in U.S. Pat. No. 3,840,433, U.S. Pat. No. 4,636,222, WO 1994/06942, U.S. Pat. No. 5,834,299 and WO 2008/093353. The enzyme digests the basal cells of the hair bulb and the cells of the malphigian layer (the two innermost layers of the epidermis). This is followed by loosening of hair with an attack on the outermost sheath and subsequent breakdown of the inner root sheath and parts of the hair that are not fully keratinized. Enzymes used in dehairing are generally proteolytic which catalyzes the breakdown of proteins. Examples of proteases which have been used are more or less crude protease extracts of bacterial or fungal origin containing different peptidase activities, as well as more pure proteases such as elastase, subtilisins, trypsins, chymotrypsin, aspartic proteases, cysteine protease and metalloproteases. However, since hides and skins primarily are made up of collagens which are susceptible to degradation by protease, there is a risk of grain damage to the skin or hide when using proteases. Furthermore, proteases may not be able to remove the hair completely, leaving an undesired stubble and potentially an uneven color on the skins or hides.

Continuous efforts are needed to design an ideal enzyme for dehairing, which provides sufficient hair removal and minimum damage to the leather. Furthermore, the generation of a more environment-friendly beamhouse process is also desired.

DETAILED DESCRIPTION OF THE INVENTION

One aspect of the present invention is the use of a glutamyl endopeptidase to loosen hairs on skins and/or hides, which results in improved removal of hair, hair roots and hair papillae in leather.

A further aspect of the present invention is a modified beamhouse process, which includes a glutamyl endopeptidase dehairing step. The modified process reduces the processing time and also allows for reduction or avoidance of polluting chemicals such as sulphide and lime.

DEFINITIONS

The term "glutamyl endopeptidase" means a peptidase, preferably a serine endopeptidase that cleaves on the carboxy-terminal side of a glutamic acid residue and to some extent of an aspartic acid residue depending on the buffer. Peptidases classified as EC 3.4.21.19 enzymes or as EC 3.4.21.82 enzymes are glutamyl endopeptidases. Enzymes classified outside these EC classes may, however, also be glutamyl endopeptidase. It can be assessed whether a peptidase is a glutamyl endopeptidase by testing its preference for cleaving Glu-|-Xaa compared to Non-Glu-|-Xaa. A screening assay for identifying whether a serine endopeptidase is a glutamyl endopeptidase suitable for the present inventions is described in the method of Example 1. This assay is also suitable for identifying glutamyl endopeptidase activity.

The term "isolated polypeptide" means a polypeptide that is purified by the hand of man relative to that polypeptide as found in nature. In one aspect, the polypeptide is at least 1% pure, e.g. at least 5% pure, at least 10% pure, at least 20% pure, at least 40% pure, at least 60% pure, at least 80% pure, and at least 90% pure, as determined by SDS-PAGE. Preferably, the isolated polypeptide of the present invention is an isolated peptidase.

The term "LVU" or "Löhlein-Volhard unit" is a measurement for protease activity. One LVU is the amount of enzyme, which degrades 1.725 mg casein under the conditions set out here (50 mg/ml casein dissolved in water, pH adjusted with NaOH to 8.2, temperature 37° C., pH 8.2 and reaction time 60 minutes). The reaction is stopped by adding HCl and non-degraded casein is precipitated with sodium sulphate. The consumption of alkali (NaOH) in re-titration of a sample filtrate minus the consumption of alkali (NaOH) in re-titration of a blank filtrate, is a direct measure of the protease activity. The more casein which is degraded and therefore non-precipitable, the more NaOH is needed in back titration. (A. Küntzel: Gerbereichemisches Taschenbuch, $6^{th}$ edition, p. 85, Dresden and Leipzig, Germany, 1955).

The term "mature polypeptide" means a polypeptide in its final form following translation and any post-translational modifications, such as N-terminal processing, C-terminal truncation, glycosylation, phosphorylation etc. The mature polypeptide may vary depending on the host it is expressed in. In one aspect, the mature polypeptide is amino acids 95 to 316 of SEQ ID NO: 1 or amino acids 89 to 303 of SEQ ID NO: 2 or amino acids 94 to 313 of SEQ ID NO: 3 or amino acids 93 to 314 of SEQ ID NO: 4 or amino acids 69 to 288 of SEQ ID NO: 5 or amino acids 69 to 336 of SEQ ID NO: 5, amino acids 121 to 342 of SEQ ID NO: 6, acids 97 to 318 of SEQ ID NO: 7 or amino acids 169 to 355 of SEQ ID NO:8.

The term "sequence identity" as used herein describes the relatedness between two amino acid sequences. For purposes of the present invention, the degree of sequence identity between two amino acid sequences is determined using the Needleman-Wunsch algorithm (Needleman and Wunsch, 1970, *J. Mol. Biol.* 48: 443-453) as implemented in the Needle program of the EMBOSS package (EMBOSS: The European Molecular Biology Open Software Suite, Rice et al., 2000, *Trends Genet.* 16: 276-277), preferably version 3.0.0 or later. The optional parameters used are gap open penalty of 10, gap extension penalty of 0.5, and the EBLOSUM62 (EMBOSS version of BLOSUM62) substitution matrix. The output of Needle labeled "longest identity" (obtained using the—nobrief option) is used as the percent identity and is calculated as follows:

(Identical Residues×100)/(Length of Alignment−Total Number of Gaps in Alignment)

The term "substantially pure polypeptide" means a preparation that contains at most 10%, at most 8%, at most 6%, at most 5%, at most 4%, at most 3%, at most 2%, at most 1%, and at most 0.5% by weight of other polypeptide material with which it is natively or recombinantly associated. Preferably, the polypeptide is at least 92% pure, e.g. at least 94% pure, at least 95% pure, at least 96% pure, at least 97% pure, at least 98% pure, at least 99%, at least 99.5% pure, and 100% pure by weight of the total polypeptide material present in the preparation. The polypeptides of the present invention are preferably in a substantially pure form. This can be accomplished, for example, by preparing the polypeptide by well known recombinant methods or by classical purification methods.

Glutamyl Endopeptidase

The present invention provides an enzymatic method for loosening hairs on hides or skins comprising treating the hides or skins with a glutamyl endopeptidase in an aqueous solution.

This specific activity towards glutamic acid has proven to be an advantage in dehairing. The treatment with glutamyl endopeptidase resulted in efficient hair removal even in the follicles where hair generally is difficult to remove with enzymatic treatment. Since glutamic acid residues also are present in collagen, it was surprising, considering this effective hair removal, to observe a very low degree of grain damage on skins and hides treated with glutamyl endopeptidase.

The loosening of hairs is part of the dehairing process. Once the keratin structure of the outer and inner root sheath of the hair is weakened, it will become loose and be more susceptible to mechanical action as well as further enzymatic or chemical action. Whether a hair has been loosened can be assessed by scraping manually across the skin or hide, e.g. with a nail or other hard material: if the hair comes off it can be considered as loosened. It can also be assessed by electron microscopy whether the sheath show signs of break down when compared to the sheaths of an untreated hide or skin.

In the method of the present invention the glutamyl endopeptidase is used in an effective amount. This is an amount which achieves a hair loosening effect compared to a skin or hide subjected to the same treatment without glutamyl endopeptidase. The skilled person will understand that the amount of glutamyl endopeptidase needed to provide a hair loosening effect may vary depending on the specific activity of the glutamyl endopeptidase used as well as the treatment conditions. Suggestions to suitable conditions, including pH range, float composition, float volume, additional enzyme activities and incubation time, are discussed in the "dehairing" section below. These conditions can be applied equally to the method for loosening hairs. The identification of the effective amount of glutamyl endopeptidase is subject to optimization under these varying conditions, which is considered routine work for the skilled person in the art. In a preferred embodiment of the present invention the amount of glutamyl endopeptidase is in the range of 5 to 1000 mg pure enzyme protein/kg of hide or skin, more preferably in the range of 10 to 900 mg pure enzyme protein/kg of hide or skin, more preferably in the range of 15 to 800 mg pure enzyme protein/kg of hide or skin more preferably in the range from 20 to 700 mg pure enzyme protein/kg of hide or skin, more preferably in the range of 25 to 600 mg pure enzyme protein/kg of hide or skin, more preferably in the range of 30 to 500 mg pure enzyme protein/kg of hide or skin, more preferably in the range from 35 to 400 mg pure enzyme protein/kg of hide or skin, even more preferably in the range from 40 to 300 mg pure enzyme protein/kg of hide or skin, even more preferably in the range from 50 to 200 mg pure enzyme protein/kg of hide or skin, even more preferably in the range from 60 to 100 mg pure enzyme protein/kg of hide or skin and most preferably in the range from 40 to 80 mg pure enzyme protein/kg of hide or skin.

A polypeptide having glutamyl endopeptidase activity may be isolated or obtained from microorganisms of any genus. For purposes of the present invention, the term "obtained from" as used herein in connection with a given source shall mean that the polypeptide encoded by a polynucleotide is produced by the source or by a strain in which the polynucleotide from the source has been inserted. In one aspect, the polypeptide obtained from a given source is secreted extracellularly. In a preferred embodiment, the glutamyl endopeptidase is a substantially pure polypeptide.

The glutamyl endopeptidase may be a bacterial polypeptide. For example, the glutamyl endopeptidase may be a polypeptide derived from gram-positive bacteria such as a *Bacillus, Clostridium, Enterococcus, Geobacillus, Lactobacillus, Lactococcus, Oceanobacillus, Staphylococcus, Streptococcus*, or *Streptomyces* polypeptide having glutamyl endopeptidase activity, or a polypeptide derived from gram-negative bacteria such as a *Campylobacter, E. coli, Flavobacterium, Fusobacterium, Helicobacter, Ilyobacter, Mesorhizobium, Neisseria, Pseudomonas, Rhodopirellula, Salmonella, Sorangium* or *Ureaplasma* polypeptide having glutamyl endopeptidase activity.

In one aspect, the glutamyl endopeptidase is derived from the genus of *Bacillus*, more preferably from a species selected from the group consisting of *Bacillus alkalophilus, Bacillus amyloliquefaciens, Bacillus brevis, Bacillus cereus, Bacillus circulans, Bacillus clausii, Bacillus coagulans, Bacillus firmus, Bacillus halmapalus, Bacillus horikoshii, Bacillus lautus, Bacillus lentus, Bacillus licheniformis, Bacillus megate-*

*rium, Bacillus pumilus, Bacillus stearothermophilus, Bacillus subtilis*, and *Bacillus thuringiensis*. Alternatively, the glutamyl endopeptidase may be derived from a species selected from the group consisting of *Clostridium tetani, Mesorhizobium lotil, Sorangium cellulosum, Rhodopirellula baltica, Staphylococcus aureus, Staphylococcus epidermidis, Streptococcus equisimilis, Streptococcus pyogenes, Streptococcus uberis, Streptococcus equi$_{Zoo}$ epidemicus, Streptomyces achromogenes, Streptomyces avermitilis, Streptomyces coelicolor, Streptomyces fradiae, Streptomyces griseus*, and *Streptomyces lividans*.

Glutamyl endopeptidases suitable for use in the present invention can be identified according to the method of Example 1. In a preferred embodiment of the present invention the glutamyl endopeptidase has a glutamyl endopeptidase ratio of at least 10.

In an embodiment the glutamyl endopeptidase is the glu-specific protease from *Bacillus licheniformis* indicated in SEQ ID NO: 1, preferably the mature glutamyl endopeptidase of SEQ ID NO: 1, more preferably amino acids 95 to 316 of SEQ ID NO: 1. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 1 preferably to amino acids 95 to 316 of SEQ ID NO: 1, where the polypeptide has glutamyl endopeptidase activity. The cloning of the DNA encoding SEQ ID NO: 1 as well as the expression of SEQ ID NO: 1 is described in EP 482879. The Glutamyl endopeptidase from *Bacillus licheniformis* is also described in U.S. Pat. No. 4,266,031 and WO 1991/13554.

In another embodiment the glutamyl endopeptidase is the glu-specific protease from *Bacillus pumilus* Ja96 indicated in SEQ ID NO: 2, preferably the mature glutamyl endopeptidase of SEQ ID NO: 2, more preferably amino acids 89 to 303 of SEQ ID NO: 2. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 2 preferably to amino acids 89 to 303 of SEQ ID NO: 2, where the polypeptide has glutamyl endopeptidase activity. The cloning of the DNA encoding SEQ ID NO: 2 as well as the expression of SEQ ID NO: 2 is described in WO 01/16285 where SEQ ID NO: 12 corresponds to SEQ ID NO: 2 of the present application. SEQ ID NO: 2 is also available as UNIPROT accession number Q2HXL7. Miyaji et al, 2006 J. Jpn. Ass. Food Preserv. Sci. 32:5-11 also describes purification and characterization of this glutamyl endopeptidase.

In another embodiment the glutamyl endopeptidase is the glu-specific protease from *Bacillus subtilis* indicated in SEQ ID NO: 3, preferably the mature glutamyl endopeptidase of SEQ ID NO: 3, more preferably or amino acids 94 to 313 of SEQ ID NO: 3. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 3 preferably to amino acids 89 to 303 of SEQ ID NO: 3, where the polypeptide has glutamyl endopeptidase activity. FIG. 14 of U.S. Pat. No. 5,589,383 discloses the DNA and protein sequence corresponding to SEQ ID NO: 3 and characterizes the polypeptide. The cloning and expression is furthermore described in WO 2001/16285 where SEQ ID NO: 14 corresponds to SEQ ID NO: 3 of the present invention.

In another embodiment the glutamyl endopeptidase is the glu-specific protease from *Bacillus licheniformis* indicated in SEQ ID NO: 4, preferably the mature glutamyl endopeptidase of SEQ ID NO: 4, more preferably or amino acids 93 to 314 of SEQ ID NO: 4. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 4 preferably to amino acids 93 to 314 of SEQ ID NO: 4, where the polypeptide has glutamyl endopeptidase activity. The cloning of the DNA encoding SEQ ID NO: 4 as well as the expression of SEQ ID NO: 4 is described in WO01/16285 where SEQ ID NO: 6 corresponds to SEQ ID NO: 4 of the present application.

In another embodiment the glutamyl endopeptidase is the glu-specific protease from *Staphylococcus aureus* indicated in SEQ ID NO: 5, preferably the mature glutamyl endopeptidase of SEQ ID NO: 5, more preferably or amino acids 69 to 288 of SEQ ID NO: 5 or amino acids 69 to 336 of SEQ ID NO: 5. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 5 preferably to amino acids 69 to 288 of SEQ ID NO: 5 or amino acids 69 to 336 of SEQ ID NO: 5, where the polypeptide has glutamyl endopeptidase activity. The glutamyl endopeptidase of SEQ ID NO: 5 is available under UNIPROT accession number P0C1U8 and its cloning and expression is described in JP4211370 and in Carmona and gray, 1987, Nucl Acid Res, 15: 6757.

In another embodiment the glutamyl endopeptidase is the glu-specific protease from *Bacillus horikoshii* indicated in SEQ ID NO: 6, preferably the mature glutamyl endopeptidase of SEQ ID NO: 6, more preferably amino acids 121 to 342 of SEQ ID NO: 6. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 6 preferably to amino acids 121 to 342 of SEQ ID NO: 6, where the polypeptide has glutamyl endopeptidase activity. The cloning of the DNA encoding SEQ ID NO: 6 as well as the expression of SEQ ID NO: 6 is described in WO01/16285 where SEQ ID NO: 4 corresponds to SEQ ID NO: 6 of the present application.

In another embodiment the glutamyl endopeptidase is the glu-specific protease from *Bacillus licheniformis* indicated in SEQ ID NO: 7, preferably the mature glutamyl endopeptidase of SEQ ID NO: 7, more preferably or amino acids 97 to 318 of SEQ ID NO: 7. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 7 preferably to amino acids 97 to 318 of SEQ ID NO: 7, where the polypeptide has glutamyl endopeptidase activity. The cloning of the DNA encoding SEQ ID NO: 7 as well as the expression of SEQ ID NO: 7 is described in WO 2001/16285 where SEQ ID NO: 10 corresponds to SEQ ID NO: 7 of the present application.

In another embodiment the glutamyl endopeptidase is the glu-specific protease from *Streptomyces griseus* indicated in SEQ ID NO: 8, preferably the mature glutamyl endopeptidase of SEQ ID NO: 8, more preferably or amino acids 169 to 355 of SEQ ID NO: 8. In a further embodiment the glutamyl endopeptidase is a polypeptide having at least 60%, e.g. at least 65%, at least 70%, at least 75%, at least 80%, at least 85%, at least 90%, at least 95%, at least 96%, at least 97%, at least 98%, at least 99% sequence identity to the mature polypeptide of SEQ ID NO: 8 preferably to amino acids 169 to 355 of SEQ ID NO: 8, where the polypeptide has glutamyl endopeptidase activity. The cloning and characterization of the gene encoding the protein sequence corresponding to SEQ ID NO: 8 is disclosed in: Sidhu S. S., Kalmar, G. B, Borgford T. J.: Characterization of the gene encoding the glutamic-acid-specific protease of *Streptomyces griseus*. Biochem. Cell. Biol. 71:454-461 (1993).

The sequence identities of the glutamyl endopeptidases from SEQ ID NO: 1 to 8 is indicated below:

| | ID1 | ID2 | ID3 | ID4 | ID5 | ID6 | ID7 | ID8 |
|---|---|---|---|---|---|---|---|---|
| ID1 | 100.00 | 35.15 | 47.62 | 80.19 | 30.04 | 37.28 | 83.12 | 33.33 |
| ID2 | 35.15 | 100.00 | 35.48 | 38.73 | 29.23 | 39.72 | 40.21 | 31.18 |
| ID3 | 47.62 | 35.48 | 100.00 | 46.60 | 31.15 | 34.06 | 46.98 | 29.54 |
| ID4 | 80.19 | 38.73 | 46.60 | 100.00 | 32.30 | 36.93 | 85.94 | 30.94 |
| ID5 | 30.04 | 29.23 | 31.15 | 32.30 | 100.00 | 30.26 | 28.84 | 28.40 |
| ID6 | 37.28 | 39.72 | 34.06 | 36.93 | 30.26 | 100.00 | 39.86 | 25.11 |
| ID7 | 83.12 | 40.21 | 46.98 | 85.94 | 28.84 | 39.86 | 100.00 | 31.10 |
| ID8 | 33.33 | 31.18 | 29.54 | 30.94 | 28.40 | 25.11 | 31.10 | 100.00 |

In a preferred embodiment the glutamyl endopeptidase used in the present invention is substantially pure.

A glutamyl endopeptidase, or one or more glutamyl endopeptidases, may be added to a conventional beamhouse process such as the one described in Example 2 or variations thereof. The glutamyl endopeptidase may for example be added in the conventional soaking, preferably the last 1 to 4 hours of the soak. Alternatively, it can be added as a separate step before or after the conventional liming step.

In a preferred embodiment of the present invention a glutamyl endopeptidase or one or more glutamyl endopeptidases, for example one or more selected from the group consisting of the glutamyl endopeptidase or mature glutamyl endopeptidase of SEQ ID NO: 1, 2, 3, 4, 5, 6, 7 and 8, is applied in a modified beamhouse process as described in the "beamhouse process" section below.

Beamhouse Process

The process of the present invention may be applied to any skin or hide conventionally used for leather manufacturing. In particular, the process of the invention may be applied to ovine skins, porcine skins, bovine hides, or caprine skins.

In the processes steps described below percentages are on weight of hide, skin or pelt unless otherwise indicated.

Soaking

When the salted skins or hides enter the beamhouse they are subjected to a dirt soak to remove salt and dirt. The duration can be adapted to the process of the beamhouse and may vary from 1 hour to 12 hours, preferably between 1 and 2 hours. The conventional dirt soak is performed without enzymes. In a preferred embodiment of the present invention the dirt soak is performed without addition of enzymes. In an alternative embodiment an enzyme preferably a serine protease, more preferably a subtilisin, a trypsin, trypsin-like protease or chymotrypsin, the protease may be applied in an amount from 6000 LVU/kg hide to 130000 LVU/kg hide, preferably from 12000 LVU/kg hide to 75000 LVU/kg hide, more preferably from 24000 LVU/kg hide to 48000 LVU/kg hide. Suitable proteases are described in the section "Leather processing enzymes". In general, the soak float is discarded on conclusion of the soak.

The dirt soak is normally followed by a longer soak which conventionally is between 8 and 72 hours. This soak serves to rehydrate the skins or hides and starts the opening of the fibre structure. In a preferred embodiment of the present invention the soaking time is reduced to 1 to 6 hours, preferably between 1.5 and 5 hours, even more preferably between 2 and 4 hours, and most preferably between 2 and 3 hours. The soaking step may comprise an effective amount of alpha-amylase is added to the soaking step. Suitable alpha-amylases are described in the section "Leather processing enzymes" The effective amount can be assessed by the skilled person in the art, preferably it is between 1 mg to 1000 mg enzyme protein/kg of skin or hide, preferably from 5 mg to 500 mg enzyme protein/kg of skin or hide, more preferably from 7 mg to 250 mg enzyme protein/kg of skin or hide, more preferably from 10 mg to 150 mg enzyme protein/kg of skin or hide, most preferably from 12 mg to 75 mg enzyme protein/kg of skin or hide. In addition to the amylase a protease may be added to the soaking step, preferably a serine protease, more preferably a subtilisin or a trypsin or trypsin like protease or a chymotrypsin. The protease may be applied in an amount from 6000 LVU/kg hide to 130000 LVU/kg hide, preferably from 12000 LVU/kg hide to 75000 LVU/kg hide, more preferably from 24000 LVU/kg hide to 48000 LVU/kg hide on weight of hide or skin. Suitable proteases are described in the section "Leather processing enzymes".

The soaking steps above are generally carried out in paddle, drum or mixer as mechanical agitation accelerate the soaking process. As a guideline, hides are soaked in drum with a float of 100% to 400%, preferably 200% and sheep skins especially for wool-on are soaked in paddle with a float of up to 2000%. In general, the soak float is discarded on conclusion of the soak.

A soaking process of the present invention may be performed at conventional soaking conditions, i.e. the pH of soak float in the range pH 4 to 12, preferably the range pH 6 to 10, most preferably the range pH 7 to 9; a temperature in the range of 5° C. to 32° C., preferably the range of 15° C. to 30° C., more preferably in the range of 20° C. to 30° C., and potentially together with known tensides and preservatives such as biocides, if needed.

Dehairing

As described in the background section, dehairing is conventionally preformed with sulphide and lime, or alternatively by using proteases such as trypsin, chymotrypsin and subtilisins.

The present invention provides a more environmental-friendly and efficient dehairing process. In the dehairing process of the present invention a glutamyl endopeptidase is used to treat the soaked hides or skins. Suitable glutamyl endopeptidases are described in the section "Glutamyl endopeptidase" as are the effective amounts and preferred amounts of the enzyme.

The conditions under which the treatment with glutamyl endopeptidase is performed can be varied according to the specific enzyme or combination of enzymes chosen. Some of the parameters which can be varied are described below. The parameters may either be varied alone or any combination of the parameters may be varied at the same time.

In one aspect of the invention the treatment with glutamyl endopeptidase of the soaked hides or skins is preceded by a treatment with an alpha-amylase. Preferably, the alpha-amylase treatment is performed between 1 and 6 hours, preferably between 1 to 5 hours, more preferably between 1.5 and 5 hours, even more preferably between 2 and 4 hours, and most preferably between 2-3 hours. The alpha-amylase pretreatment can either be incorporated into the soaking step as described above, it can be a treatment combined with the following unhairing step or it can be a separate treatment. The amount of alpha-amylase is as described in the "soaking" section above. Furthermore, the alpha-amylase treatment may be performed in presence of a protease preferably a serine protease (EC 3.4.21), more preferably a subtilisin, also as described in the "soaking" section above.

The glutamyl endopeptidase treatment time may be adjusted according to the activity of the enzyme, preferably the treatment time is such that there is a sufficient hair removal and very limited to no grain damage which can be assessed according to the principles of Example 3 and 4. In an embodiment of the present invention the treatment time is between 1 and 5 hours, preferably between 1.5 and 4 hours, more preferably between 2 and 3 hours and most preferably between 1.5 and 2.5 hours.

The optimal pH of the glutamyl endopeptidase should be considered when choosing the pH range in which the dehairing is performed. The activity of the enzyme can to some extent be controlled by changes in the pH, so if optimal activity is desired the pH should be chosen in a range of +/−1 pH unit of the optimal pH of the enzyme (measured at the processing temperature), In one embodiment of the invention the pH is in the range of 5.5 to 12.5, preferably in the range of 6 to 12, more preferably in the range of 6.5 to 11, more preferably in the range of 7 to 10, more preferably in the range of 7.5 to 9.5, most preferably in the range of 8 to 9. If it is desired to decrease the activity, e.g. to control grain damage, the pH may be chosen such that it is outside the optimal pH range of the enzyme (see for example U.S. Pat. No. 4,636,222). Alternatively, the pH can be changed during the glutamyl endopeptidase treatment, e.g. from the optimal pH to a pH which is outside the optimal pH range of the enzyme during the dehairing process. In one embodiment the pH change is to a pH where the enzyme loses its activity. In a further embodiment the treatment is performed in the range of 6.5 to 9.5, more preferably in the range of 7 to 9 for a period of 1 to 4 hours, preferably 1 to 3 hours, more preferably from 1 to 2 hours followed by an increase in pH to above 11, more preferably to above 12. In a preferred embodiment the glutamyl endopeptidase treatment is performed in the pH range of 5.5 to 10, followed by a gradual increase in pH to above 11. The pH increase is done gradually over 1 to 4 hours, more preferably 2 to 3.5 hours, most preferably 2.5 to 3.5 hours. This increase in pH furthermore serves to swell the skin or hide to a size that make it easier to perform fleshing and splitting.

In one aspect of the invention the dehairing treatment can be performed with glutamyl endopeptidase as the only source of enzymatic activity or preferably as the only source of proteolytic activity. Alternatively, other enzymatic activities can be added together with the glutamyl endopeptidase including alpha-amylase and/or protease. In a preferred embodiment the dehairing is performed in the presence of a protease, preferably a serine protease (EC 3.4.21), more preferably a trypsin or a trypsin-like protease, chymotrypsin or a subtilisin. The protease may be applied in an amount from 700-3.500.000 LVU/kg hide or skin, preferably from 3500-2.100.000 LVU/kg hide, more preferably from 7000-1.400.000 LVU/kg hide, even more preferably from 35000-1.000.000 LVU/kg hide or skin. Suitable proteases are described in the section "Leather processing enzymes". In a preferred embodiment NovoBate® 115 is used.

The float composition can be optimized and varied as suitable. The skilled person will know how to make such variations. Generally, the float composition is based on water; the pH of the composition can be adjusted by adding an acidic or alkaline compound. For alkaline pH (above pH 7), soda ash or hydroxide salts, e.g. NaOH, or $Ca(OH)_2$, are generally used to adjust the pH, the skilled person can however easily substitute these with other alkaline substances. For acidic pH (below 7), sulphuric acid or formic acid are generally used, the skilled person can however easily substitute these with other acidic substances. The float may also contain a preservative such as a biocide in order to prevent fouling of the hides or skins during the treatment.

The dehairing treatment is generally carried out in connection with mechanical action, e.g. using a paddle, drum or mixer as mechanical agitation accelerate process. As a guideline, hides are treated in a drum with a float of 50% to 400%, preferably from 100% to 200% and sheep skins especially for wool-on are treated in paddle with a float of up to 2000%. On conclusion of the dehairing treatment the float is generally discarded and the hair is removed from the system.

The treatment can be performed in the temperature range of 5° C. to 32° C., preferably in the range of 15° C. to 30° C., more preferably in the range of 20° C. to 30° C.

One embodiment of the present invention is a process for dehairing hides or skins comprising the steps a) treating hides or skins with an effective amount of alpha-amylase in an aqueous solution; and b) loosening the hairs with an effective amount of glutamyl endopeptidase in an aqueous solution. Where step a) can be performed as described in the "soaking" or "dehairing" section and step b) can be performed as described in the "dehairing" section. Optionally, if the pH of the glutamyl endopeptidase treatment is below 10, a pH increasing step is added after step b). This step gradually raises the pH to above 11 over a period of 1 to 4 hours.

Liming

The liming step is the conventional dehairing step in the beamhouse process which applies sulphide to reduce the disulfide bridges in the keratin molecules, and lime to loosen the collagen structure and releases interfibrillar noncollagenous proteins.

In one aspect of the present invention the treatment with sulphide and lime, or alternatives to these chemicals can be omitted since the dehairing obtained by the treatment with glutamyl endopeptidase as described above is efficient enough on its own. In one embodiment of the present invention the hairs are loosened or removed, e.g. the dehairing process or the entire beamhouse process is performed, without the addition of sulphide (or alternate disulphide reducing chemical, not including enzymes which reduce disulphide bounds), preferably the entire beamhouse process is performed without addition of sulphide (or alternate disulphide reducing chemical, not including enzymes which reduce disulphide bounds). In another embodiment the hairs are loosened or removed, e.g. the dehairing process is performed, without the addition of a liming agent. In another embodiment of the present invention the hairs are loosened or removed, e.g. the dehairing process or the entire beamhouse process is performed, without addition of a liming agent and without the addition of sulphide (or alternate disulphide reducing chemical, not including enzymes which reduce disulphide bounds). One of the advantage of not using sulphide is that the hairs remain intact (a hair saving process), which is significantly better for the environment than hairs dissolved by sulphide.

In another aspect of the present invention the dehairing is made even more effective by performing a treatment with a sulphide and/or a liming agent. In a preferred embodiment of the present invention is the pelt obtained after step b) in the dehairing process described above subjected to a sulphide treatment or treatment with an alternative protein disulphide reducing compound. Consequently, the glutamyl endopeptidase treatment is followed by a sulphide treatment or a treatment with an alternative protein disulphide reducing compound in order to release the hairs even more efficiently. In the following it should be understood that when the term sulphide is used it includes alternative protein disulphide reducing compound unless stated otherwise. The skilled person will know which sulphides are suitable in the beamhouse process, some examples are $Na_2S$, CaS and $As_2S_3$ and NaHS and other salts of same. Alternative protein disulphide reducing compound could be salts of thioglycolic acid as well as other thiols (Mercaptans) R—S—H, enzymes capable of catalysing the rearrangement of —S—S— bonds in proteins e.g. protein disulfide reductases, protein disulfide isomerases, protein disulfide oxidases, protein disulfide oxidoreductase, protein disulfide transhydrogenases, sulfhydryl oxidase, and thioredoxins. The use of these enzymes in dehairing is described in U.S. Pat. No. 5,834,299, hereby incorporated by reference. The skilled person in the art will know how to optimize the amount of sulphide. In a preferred embodiment the amount of sulphide is the range of 0.01% to 3%, preferably from 0.05% to 2%, more preferably from 0.1% to 1.5%, even more preferably from 0.15% to 1%, most preferably from 0.2% to 0.5% per kg of hide, skin or pelt. In a preferred embodiment the sulphide treatment is done without the addition of a liming agent.

In one embodiment of the invention the sulphide treatment is performed in combination with a liming agent. The sulphide treatment is performed after the treatment with glutamyl endopeptidase, preferably after the splitting of the pelt. The skilled person will know which liming agents are suitable in the beamhouse process, some examples are the conventional lime (calcium hydroxide), sodium hydroxide or alternative hydroxide salts. In one embodiment of the invention the liming agent is sodium hydroxide, which is somewhat more environmental friendly than lime because it does not produce sludge as lime does. The skilled person in the art will know how to optimize the amount of liming agent. In a preferred embodiment the amount of liming agent is the range of 0.01% to 5%, preferably from 0.05% to 4%, more preferably from 0.1% to 2.5%, even more preferably from 0.15% to 1%, most preferably from 0.2% to 0.5% per kg of hide, skin or pelt.

Another embodiment of the present invention is a process for dehairing hides or skins comprising the steps a) treating hides or skins with an effective amount of alpha-amylase in an aqueous solution; b) loosening the hairs with an effective amount of glutamyl endopeptidase in an aqueous solution; and c) treating the pelt with a liming agent and/or a sulphide. Where step a) can be performed as described in the "soaking" or "dehairing" section, step b) can be performed as described in the "dehairing" section, and c) can be performed as described in the "liming" section.

Fleshing and Splitting

The fleshing removes the fatty and muscular tissue still on the flesh side of the hide. The splitting is a horizontal cutting of the dehaired hide (pelt) into a grain split and a flesh split. The grain split is used for the production of upper leathers, whereas the flesh split can be used for split leather or gelatin. The fleshing and splitting are performed as separate steps during the beamhouse process, but for ease we describe them together. The fleshing and splitting is conventionally performed after the liming. In the present invention the fleshing and splitting can be done after the dehairing with glutamyl endopeptidase and prior to the liming and/or sulphide treatment. The advantage of this procedure is that the weight of the pelt is decreased significantly before the liming. Since lime and sulphide is dosed per kg of hide, skin or pelt the amount of lime and sulphide, which has a high environmental impact, can be reduced to the same extent as the weight reduction of the skin, hide or pelt. Another advantage of fleshing and splitting the hide before sulphide treatment is that the waste stream (meat, fat and split leather) is free of sulphide which is an advantage if it is processed to for example gelatin. In a preferred embodiment of the present invention the hide, skin or pelt is fleshed and split prior to treatment with sulphide and/or liming agent.

Another embodiment of the present invention is a process for dehairing hides or skins comprising the steps a) treating hides or skins with an effective amount of alpha-amylase in an aqueous solution; b) loosening the hairs with an effective amount of glutamyl endopeptidase in an aqueous solution; c) fleshing and splitting of the pelt obtained in b), and d) treating the pelt with a liming agent and/or a sulphide. Where step a) can be performed as described in the "soaking" or "dehairing" section, step b) can be performed as described in the "dehairing" section, step c) can be performed as described in the "fleshing and splitting" section, and step d) can be performed as described in the "liming" section. Step d) can alternatively be performed before step c) even though this would not result in the environmental gain.

Deliming

In the conventional beamhouse process deliming is performed after the liming agent, to remove the liming agent from the pelts and to reduce the pH to between 8, and 9. The reduction in pH is important to prepare the pelt for de remaining part of the beamhouse process.

In relation to the present invention deliming or a pH reduction step is performed if the process has made use of a liming agent. In the process of the present invention a pH reduction step may also be performed even if a liming agent has not been used, for example in cases where the glutamyl endopeptidase treatment has either been performed at pH above 9 or where the pH has been raised during or subsequent to the glutamyl endopeptidase treatment.

Pickling and Tanning.

These processes are the remaining steps in the beamhouse process and will not be affected by the modified procedures described above. Some beamhouse processes also include a bating step which serves to remove additional proteins, this is however an optional step in the beamhouse process of the present invention. The skilled person in the art will know how to conduct these steps. An example of how the steps can be conducted is described in Example 2.

Modified Beamhouse Processes

The modified beamhouse process of the present invention may take different forms. If it is technically feasible in relation to the beamhouse process the steps may be interchanged. In a preferred embodiment of the invention the beamhouse process is reduce to between 20 and 30 hours, preferably to 22-28 hours, more preferably to 24 to 26 hours. Some modified beamhouse process in accordance with the present invention are illustrated below (these examples are not exhausting; alternatives that can be constructed by combing different features from the description above are also considered a part of the present invention).

A process for preparing a wet blue comprising the following steps:

a) a dirt soak;

b) a soak comprising a alpha-amylase and optionally a protease;

c) dehairing with an effective amount of glutamyl endopeptidase in an aqueous solution;

d) fleshing and splitting the pelt obtained in c);

e) deliming; and e) pickling and tanning.

Where step a) and b) can be performed as described in the "soaking" section, step c) can be performed as described in the "dehairing" section and d) can be performed as described in the "fleshing and splitting" section.

A process for preparing a wet blue comprising the following steps:

a) a dirt soak;

b) a soak comprising a alpha-amylase and optionally a protease;

c) dehairing with an effective amount of glutamyl endopeptidase in an aqueous solution;

d) fleshing and splitting the pelt obtained in c)

e) treatment with a liming agent and/or a sulphide f) deliming;

g) pickling and tanning.

Where step a) and b) can be performed as described in the "soaking" section, step c) can be performed as described in the "dehairing" section, step d) can be performed as described in the "fleshing and splitting" section, step e) can be performed as described in the "liming" section.

A process for preparing a wet blue comprising the following steps:

a) a dirt soak;

b) a soak comprising a alpha-amylase and optionally a protease;

c) dehairing with an effective amount of glutamyl endopeptidase in an aqueous solution;

d) treatment with a liming agent and/or a sulphide;

e) fleshing and splitting;

f) deliming; and g) pickling and tanning.

Where step a) and b) can be performed as described in the "soaking" section, step c) can be performed as described in the "dehairing" section, step d) can be performed as described in the "liming" section, step e) can be performed as described in the "deliming" section, and step f) can be performed as described in the "fleshing and splitting" section.

Leather Processing Enzymes

Proteases

In addition to the glutamyl endopeptidase described above other proteases or a proteolytic enzyme can be added to different steps of the leather making process, for example to remove non-collagenous proteins, open of the fiber structure of the pelt.

Suitable proteases include those of animal, vegetable or microbial origin. Microbial origin is preferred. Chemically modified or protein engineered mutants are included. The protease may for example be a metalloendopeptidase (EC 3.4.24), a cysteine endopeptidease (EC 3.4.22), an aspartic endopeptidase (EC 3.4.23) or a serine endopeptidase (EC 3.4.21). Examples of serine proteases are trypsins (EC 3.4.21.4), Chymotrypsins (EC 3.4.21.1 and EC 3.4.21.2) subtilisins (EC 3.4.21.62). Especially subtilisins derived from *Bacillus*, e.g., *Bacillus* BP92 protease, subtilisin BPN', subtilisin Novo, subtilisin Carlsberg, subtilisin 309, subtilisin 147 and subtilisin 168 (described in WO 89/06279). Examples of trypsin-like proteases are trypsin (e.g., of porcine or bovine origin) and the *Fusarium* protease described in WO 89/06270 and WO 94/25583 as well as trypsin acting fungal proteases obtained from *Aschersonia, Beauvaria, Metarhizium* and *Verticillium* (EP 335,023).

Examples of useful serine proteases are the variants described in WO 92/19729, WO 98/20115, WO 98/20116, and WO 98/34946, especially the variants with substitutions in one or more of the following positions: 27, 36, 57, 76, 87, 97, 101, 104, 120, 123, 167, 170, 194, 206, 218, 222, 224, 235, and 274.

Examples of cysteine proteases are papains.

Aspartic endopeptidases may be derived from *Mucor miehei, Mucor pusillus* and *Cryphonectria* (*Endothia*) *parasitica*. Commercial products with aspartic endopeptidases are marketed under the trade names Rennilase®, Fromase®, Novoren®, Marzyme®, Hannilase®, Marzyme® and Suparen®.

Preferred commercially available protease enzymes include Biobate® AC, NUE (Novozymes Unhearing Enzyme), Neutrase®, NovoBate®100, NovoBate® 115, NovoBate®1547, NovoCor® S 2500 C, NovoCor® AB, NovoCor® AX, NovoCor® B, Alcalase®, Savinase®, Primase®, Duralase®, Esperase®, Everlase®, Liquanase®, Relase®, Polarzyme® and Kannase® (Novozymes A/S), Properase®, Purafect®, Purafect OxP®, FN2™, and FN3™ (Genencor International Inc.), Ronozyme® ProAct (DSM).

Alpha-Amylase

The amylase used in the process of the invention may be any alpha-amylase (EC. 3.2.1.1), which catalyzes the hydrolysis of starch and other linear and branched 1,4-glucosidic oligo- and polysaccharides. In a preferred embodiment the alpha-amylase is an alkali alpha-amylase, when the optimal pH condition for reaction is 7-9. Suitable alpha-amylases include those of bacterial or fungal origin. Chemically or genetically modified mutants (variants) are included.

In a preferred embodiment the alpha-amylase include a carbohydrate-binding module (CBM) as defined in WO 05/003311, preferably a family 20 CBM as defined in WO 05/003311.

In an embodiment the fungal alpha-amylase is of yeast or filamentous fungus origin. Preferred alpha-amylases include, for example, alpha-amylases obtainable from *Aspergillus* species, in particular from *Aspergillus niger, A. oryzae, A. awamori* and *A. kawachii*, such as the acid alpha-amylase disclosed as SWISSPROT P56271, or described in more detail in WO 89/01969 (Example 3).

In an embodiment the alpha-amylase is of bacterial origin. The bacterial alpha-amylase is preferably derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512 (WO 95/26397), NCIB 12513 (WO 95/26397), DSM 9375 (WO 95/26397), DSMZ 12648 (WO 00/60060), DSMZ 12649 (WO 00/60060), KSM AP1378 (WO 97/00324), KSM K36 or KSM K38 (EP 1,022,334). Preferred are the *Bacillus* sp. alpha-amylases disclosed in WO 95/26397 as SEQ ID NOS. 1 and 2, respectively, the AA560 alpha-amylase disclosed as SEQ ID NO: 2 in WO 00/60060. Preferably, *Bacillus licheniformis* alpha amylase is SEQ ID NO: 2 as disclosed in WO 96/23874.

In an embodiment of the invention, the bacterial alpha-amylase is the SP722 alpha-amylase disclosed as SEQ ID NO: 2 in WO 95/26397 or the AA560 alpha-amylase.

Alpha-amylases suitable for soaking are described in WO 10/043709. The alpha-amylases indicated as SEQ ID NO:1 and SEQ ID NO:4 in WO 10/043709, and polypeptides having at least 80% identity, preferably 90% identity, more preferably 95% identity to these sequences are also of interest for the amylase treatment in the present invention.

Commercially available alpha-amylase products or products comprising alpha-amylases include product sold under the following tradenames: Relevant commercially available amylases include Natalase®, Stainzyme®, Stainzyme Plus, Duramyl®, Termamyl®, Termamyl Ultra, Fungamyl® and BAN® (all available from Novozymes A/S, Bagsvaerd, Denmark), Bioamylase-D(G), BIOAMYLASE™ L (Biocon India Ltd) and Rapidase® and (available from DSM, Holland) and Purastar®, Purastar OxAm, RAPIDASE™ TEX and Powerase™ (available from Danisco A/S) KAM (KAO, Japan).

EXAMPLES

The invention is further illustrated with reference to the following examples, which are not intended to be in any way limiting to the scope of the invention as claimed.

Example 1

The present example describes an assay for assessing whether an enzyme preparation is a glutamyl endopeptidase in the context of the present invention.

Glutamyl endopeptidases are serine endopeptidases that cleave on the carboxy-terminal side of a glutamic acid residue (or an aspartic acid residue in phosphate buffers), i.e. they have a preference for negatively charged amino acid residues in the P1 position.

The following assay was used to test whether a peptidase is a glutamyl endopeptidase.

Materials:

Substrates: Suc-AAPA-pNA (Bachem L-1775)
Suc-AAPR-pNA (Bachem L-1720)
Suc-AAPE-pNA (Bachem L-1710)
Suc-AAPI-pNA (Bachem L-1790)
Suc-AAPL-pNA (Bachem L-1390)
Suc-AAPK-pNA (Bachem L-1725)
Suc-AAPM-pNA (Bachem L-1395)
Suc-AAPF-pNA (Bachem L-1400)
Suc-AAPV-pNA (Bachem L-1770)

All available from Bachem AG, Bubendorf, Schwizerland.

Temperature: Room temperature (25° C.)

Assay buffer: 100 mM succinic acid, 100 mM HEPES, 100 mM CHES, 100 mM CABS, 1 mM $CaCl_2$, 150 mM KCl, 0.01% Triton X-100, pH 9.0.

Enzymes:

| Enzyme | SEQ ID NO: | Public references |
|---|---|---|
| Glutamyl endopeptidase from *B. licheniformis* | 1 | UniProt P80057, EP482879 |
| Glutamyl endopeptidase from *Bacillus pumilus* Ja96 | 2 | UniProt Q2HXL7 WO20011628 SEQ ID NO: 12 |
| Subtilisin from *B. licheniformis*, Alcalase 2.5L | None | Available at Novozymes A/S |
| Bovine chymotrypsin | None | Sigma C-3142 TLCK treated |
| Trypsin-like protease from *Fusarium oxysporum* | None | UniProt P35049 PCT/EP2010/054290 SEQ ID NO: 2 |

The enzymes were purified by chromatography to a high purity. Only one band was seen for each peptidase on coomassie stained SDS-PAGE gels.

Method:

20 μl peptidase dilution (diluted in 0.01% Triton X-100) was placed in a well in a microtiter plate. The assay was started by adding 200 μl pNA substrate (50 mg dissolved in 1.0 ml DMSO and further diluted 90× with the Assay buffer). The microtiter plate was placed in a VERSAmax microplate reader from Molecular Devices and the initial increase in OD405 was monitored as a measure of the peptidase activity. If a linear plot was not achieved in the 4 minutes measuring time, the peptidase was diluted further and the assay was repeated.

Results:

The results of the five proteases tested in the above assay are indicated in Table 1 below. The data corresponds to the relative activities for each protease on the nine different Suc-AAPX-pNA substrates, i.e. the activity of the specific Suc-AAPX-pNA substrate divided by the activity of the Suc-AAPX-pNA substrate of the nine substrates with the highest activity. The dilution of the peptidase was accounted for in the calculation.

TABLE 1

| | Glu-endopep. *B. licheniformis* | Glu-endopep. *B. pumilus* JA96 | Alcalase | Chymotrypsin | Trypsin |
|---|---|---|---|---|---|
| Suc-AAPA-pNA | 0.00000 | 0.00373 | 0.02381 | 0.00087 | 0.00000 |
| Suc-AAPR-pNA | 0.00001 | 0.00184 | 0.00861 | 0.00619 | 1.00000 |
| Suc-AAPI-pNA | 0.00000 | 0.00029 | 0.00012 | 0.00072 | 0.00000 |
| Suc-AAPM-pNA | 0.00000 | 0.03411 | 0.39459 | 0.34762 | 0.00002 |
| Suc-AAPV-pNA | 0.00000 | 0.00110 | 0.00016 | 0.00037 | 0.00000 |
| Suc-AAPL-pNA | 0.00000 | 0.02221 | 0.81752 | 0.22435 | 0.00000 |
| Suc-AAPK-pNA | 0.00000 | 0.00234 | 0.01389 | 0.00033 | 0.53071 |
| Suc-AAPF-pNA | 0.00001 | 0.01321 | 1.00000 | 1.00000 | 0.00003 |
| Suc-AAPE-pNA | 1.00000 | 1.00000 | 0.00112 | 0.00025 | 0.00000 |
| Glutamyl endo-peptidase ratio | 103100 | 29 | 0.001 | <0.001 | <0.001 |

From the results it can be seen that the Glutamyl endopeptidase from *B. licheniformis* and Glutamyl endopeptidase from *Bacillus pumilus* JA96 have the highest activity on pNA substrate Suc-AAPE-pNA, whereas they have fairly low relative activity towards the other substrates. Consequently, both these proteases are considered to be glutamyl endopeptidases.

In order to assess whether a peptidase is a glutamyl endopeptidase we have defined a glutamyl endopeptidase ratio (GR) which is calculated as follows:

GR=activity on Suc-AAPE-pNA/Suc-AAPnon(E)-pNA with highest activity

When the glutamyl endopeptidase ratio is 10 or above, the activity on any of the 8 other SucAAPnon(E)-pNA substrates is less than 10% of the activity on the Suc-AAPE-pNA substrate.

A glutamyl endopeptidase according to the present invention is defined as a peptidase with a GR above 10.

The Alcalase, chymotrypsin and trypsin, which all have been used in leather processing, are not considered to be glutamyl endopeptidases according to the present invention.

Example 2

This example illustrates a standard beamhouse process from soaking to tanning. The process may vary from tannery to tannery, and is therefore only an example, not a universal recipe.

The raw materials for the production of leather are in the following entered as salted hides. Dosages are stated as percent on weight of hide/pelt.

Dirt Soak

Salted hides are loaded into tannery drums with 200% float (water) (10-25° C.) and drummed 1-2 hours to remove salt and dirt. Then float is drained.

Soaking

In order to rehydrate the hides and to start opening the fiber structure 150% float (water) at 10-25° C. is filled into the drums containing the hides from the dirt soak. pH is adjusted by adding Soda ash (around 0.5%) to obtain pH 9.0-9.5. In order to inhibit bacterial growth bactericides are often added too. After 4 hours pH and salt content in the float is checked. Salt should give a Bé between 2-3, if not a washing step is introduced. Leave the drums overnight, running 10 minutes every hour. Next morning the float is drained from the drums.

Liming 1.5% $Na_2S$ (65% in solid) is added to the wet hides and the drum run 30 minutes while the sulphide dissolves and burns (dissolves) the hair. Then 30% water is added followed by 2% lime. The drums are run 3-4 hrs continuously followed by 5 minutes per hour overnight.

Fleshing and Splitting

Next morning the unhaired swollen pelts are taken out of the drum to be fleshed to remove fatty tissue followed by splitting to obtain adequate thickness of the grain. The pelts (the grain part of the unhaired hides) go back into the drum to be delimed.

All the following dosages are as pct on the weight of the split pelt.

Deliming

After the pelts have been loaded into the drum they are washed in 200% water 10-25° C. for 15 minutes. Water is drained and a new float is established with 35% water 20-25° C., 3% $(NH_4)_2SO_4$ and 0.5% $NaHSO_3$ (technical grade). The drums are run 1 hour and pH is checked by cutting the pelt and applying Phenolphthalein in the cut. The reaction must be colorless all the way through the transection of the pelt. If not, the run is extended till the cut is colorless.

Bating

To remove non-collagen proteins a bating step may be performed. To the deliming float 0.01% of an 8000 LVU/g bate (protease) (Examples of commercial bating products can be found in Table 1 of Thanikaivelan et al, 2004, Trend in Biotechnology 22, 181-187). Maintain temperature while drumming 30 minutes to 1 hour then drain the float. Wash one time by adding 200% water 10-25° C. and run the drum 30 minutes. Drain.

Pickling

Establish the pickle float on the bated pelt by adding 60% water 18° C. and 6% NaCl. Run 15 minutes and check if Bé has reached >6, if not add additional NaCl. Then add 0.7% formic acid and run for 10 minutes. Then add 0.3% $H_2SO_4$ (concentrated) and drum 20 minutes and then add additional 0.3% $H_2SO_4$. Let the drum run 1.5 to 3 hours.

Measure pH in the pickled pelt by cutting the pelt and applying Thymol blue. If the thymol blue is red, it is between pH 2 and 3; if not, add additional $H_2SO_4$.

Chrome Tannage

To the pickle float add 7.5% Tanchrome AB (Sisecam Chemicals Group, Istanbul, Turkey) and run 1.5 hours. Then add the chrome fixating agent 0.4% Kromofix (Sisecam Chemicals Group, Istanbul, Turkey) and run 7 hours. After the tanning process the so called Wet Blue are obtained, this is a stabilized wet leather form than can be left as such for later processing.

Example 3

The purpose of the present example was to evaluate glutamyl endopeptidase (Having SEQ ID NO: 1) from *Bacillus lichenformis* ability of removing hair and providing fiber opening without damaging the grain in a modified beamhouse process.

All percentages mentioned are on weight of hide/pelt.

Dirt Soak

Pieces of salted Scottish brown white dairy cow was soaked in 200% float (water) containing 0.1% Novocor S 2500 C (subtilisin, Novozymes A/S) at 25° C. in a pilot tanning drum. After 1 hr the float was removed.

Modified Soak

200% fresh float (water) at 25° C. was added to the hides. A biocide (0.01% Myacide) was added together with 13 mg enzyme protein/kg of hide of an alpha-amylase and 0.4% Novocor S 2500 C (subtilisin, Novozymes A/S). The drum was rotated continuously for 4 hours. Then the float was removed.

Dehairing

50% float (water) is added at 25° C. and pH was adjusted with a 1% $NaHCO_3$ or a 1% Formic acid solution to fit the values 7.5, 8.5 or 9.5. Biocide was also added (0.01% Myacide). The drum was rotated for 30 minutes to allow pH to adjust. Glutamyl endopeptidase from *Bacillus lichenformis* was added (in the range from 0 to 400 mg pure enzyme/kg of hide) together with a trypsin based protease like Novobate® 115 (0.01%). The drum was rotated continuously for 4 hours. The float was removed and the hair was removed from the system.

Liming

A new float was established on 150% water at 25° C. together with 1.5% Sodium sulphide (65% in solid). The drum was run for 30 minutes followed by addition of 2% slaked lime. The chemical treatment occurs overnight with drum running 1 minute every half hour.

Deliming

Next morning the float was removed and the pelts were washed in 200% float (water) 25° C., two times during 10 minutes. Then a deliming float was established by adding 50% water at 25° C., 3.5% $(NH4)_2SO_4$ and 0.3% $Na_2S_2O_5$ running for 90 minutes before cutting and checking pH in the pelts (as described in Example 2).

The hide pieces were then preserved in formalin and analyzed with respect to hair removal, fiber opening and grain damage.

Assessment of Grain Damage by Scanning Electron Microscopy (SEM)

This analysis assessed the presence of any grain damage on the surface of a sample of leather.

The wet blues obtained above were freeze dried to remove all moisture before analysis.

Small samples (approximately 5 mm×5 mm) were cut using a scalpel and mounted onto SEM aluminium stubs using adhesive carbon tabs.

The samples were gold coated before the analysis using the SEM.

The grain surface was assessed at ×100 and at ×500 magnification for evidence of grain damage such as open grain fibers grain distortion.

Assessment of Fiber Structure by Scanning Electron Microscopy (SEM)

This analysis assessed the fiber opening of sections of leather/skin.

The wet blues produced above were freeze dried to remove all moisture before analysis.

Sections (approximately 10 mm long and 2 mm thick) were cut using a scalpel blade and mounted onto aluminium SEM stubs using adhesive carbon tabs.

The samples were gold coated before the analysis using the SEM.

Assessment of the fiber structure was carried out using an image taken from the centre of the cross-section of the sample at ×150 magnification.

Features such size as separation of the fiber bundles and fibrils along with the angle of fiber weave were used in the assessment.

Sample Preparation for the Assessment of Hair Removal by Light Microscopy

This analysis assessed the presence of any remaining hair within sections of skin.

The wet blues produced above were washed in distilled water before being sectioned in a freezing microtome at 60 μm.

The thin sections were mounted onto microscope slides for analysis.

Analysis was conducted using light microscopy from ×100 to ×1000 magnification.

Features such as hair remaining in the hair shaft and hair root were observed.

The results are summarized in Table 2.

TABLE 2

| Glu-endopeptidase | pH 7.5 | | | pH 8.5 | | | pH 9.5 | | |
|---|---|---|---|---|---|---|---|---|---|
| mg EP*/kg hide | A | B | C | A | B | C | A | B | C |
| 0 | ÷ | + | + | ÷ | + | + | ÷ | + | + |
| 4 | ÷ | + | + | ÷ | + | + | ÷ | + | + |
| 20 | ÷ | + | + | ++ | + | + | + | + | + |
| 40 | + | + | + | ++ | + | + | ++ | + | + |

TABLE 2-continued

| Glu-endopeptidase | pH 7.5 | | | pH 8.5 | | | pH 9.5 | | |
|---|---|---|---|---|---|---|---|---|---|
| mg EP*/kg hide | A | B | C | A | B | C | A | B | C |
| 200 | + | + | + | + | + | ÷ | + | ÷ | ÷ |
| 400 | + | + | + | + | + | ÷ | + | ÷ | ÷ |

*EP = pure enzyme protein
A = Hair removal
B = Fiber opening
C = Grain damage
÷ = unacceptable
+ = meets or beats conventional method
++ = unexpected good results From these results it can be seen that an unexpected good hair removal can be obtained with enzyme doses of 20 mg enzyme protein/kg hide at pH 8.5 as well as with 40 mg EP/kg hide at pH 8.5 and pH 9.5.

Example 4

The purpose of the present example was to evaluate glutamyl endopeptidase (having SEQ ID NO: 1) from *Bacillus lichenformis* ability of removing hair and providing fiber opening without damaging the grain in a modified beamhouse process.

All percentages mentioned are on weight of hide/pelt.

Dirt Soak

Twenty kg of salted Dutch black and white calf was soaked in 200% float (water) containing 0.1% Novocor S 2500 C (subtilisin, Novozymes A/S) and a biocide (0.01% Busan 30WB) at 20° C. in a tanning drum. After 1 hour the float solution was removed.

Modified Soak

200% fresh float (water) at 25° C. was added to the hides. A biocide (0.01% Busan 30WB) was added together with 13 mg enzyme protein/kg of hide of an alpha-amylase and 0.4% Novocor S 2500 C (subtilisin, Novozymes A/S). The drum was rotated continuously for 4 hours. Then float solution was removed.

Dehairing

100% float (water) was added at 25° C. together with 0.3% Soda ash (or more to obtain pH 9.0-9.5) and Biocide (0.01% Busan30WB). The drum was rotated for 30 minutes to allow pH to adjust. Glutamyl endopeptidase from *Bacillus lichenformis* was added (in the range from 0 to 200 mg pure enzyme protein/kg of hide) together with a trypsin based protease like Novobate® 115 (0.01%). The drum was rotated continuously for 4 hours. Hair loosening was observed already 1-1.5 hr after addition of the glutamyl endopeptidase. The float was removed and the hair was removed from the system.

Liming

A new float was established on 50% water at 25° C. together with 1.5% Sodium sulphide (65% in solid) and 2% slaked lime. The chemical treatment occurs overnight with the drum running 5 minutes every hour.

Fleshing and Splitting

Next morning the pelts were fleshed and split.

The pelts were then delimed, pickled and chrome tanned as described in Example 2.

The wet blues obtained by this process was analyzed with respect to hair removal, fiber opening and grain damage as described in Example 3, with the addition that the different properties were graded as described below.

Assessment of Grain Damage by Scanning Electron Microscopy (SEM)

Samples were assessed using a scale from 1 to 5:

Grade 1—no damage

Grade 5—significant damage

Grades 1 to 3 result in acceptable quality of the leather.

Grade 0 is ideal.

Assessment of Fiber Structure by Scanning Electron Microscopy (SEM)

Each sample was then assessed using a scale from 1 to 5:

Grade 1—no opening up

Grade 5—over opening up

Acceptable opening is achieved between grade 2 and 3.

Ideal opening up would be considered as a grade 3 to 4.

Sample Preparation for the Assessment of Hair Removal by Light Microscopy

Each sample was then assessed using a scale from 1 to 5.

Grade 1—no dehairing, hair is fully intact

Grade 5—full dehairing, no remaining hair

Grade 3 is considered an acceptable dehairing.

Ideal dehairing is rated a grade 4 and above.

All evaluations were performed at the neck, belly and butt part of the Wet blue, the average grade is given in Table 3.

TABLE 3

| Glu-endopeptidase mg EP*/kg hide | Surface hair | Hair in follicles | Hair roots | Grain damage | Fiber opening |
|---|---|---|---|---|---|
| 0 | 2 | 1 | 1 | 0.7 | 2 |
| 20 | 2.7 | 2 | 3 | 0.3 | 1 |
| 40 | 4 | 2 | 4 | 2 | 1 |
| 60 | 4.3 | 2.7 | 4.3 | 0.3 | 2.3 |
| 100 | 4.7 | 3.7 | 4.7 | 1.3 | 1.3 |
| 200 | 4.3 | 3 | 4 | 0.7 | 2.3 |

*EP = pure enzyme protein

From these results it can be seen that a really good hair removal can be obtained with enzyme doses of 40 mg enzyme protein/kg 200 mg enzyme protein/kg hide. A significant removal of hair in the follicles is also observed with enzyme doses of 60 mg EP/kg 200 mg EP/kg hide. This is a significant result, since conventional dehairing processes frequently leaves portions of undegraded hair behind in the follicles. Finally it can be seen that grain damage and fiber opening is acceptable.

Example 5

The purpose of the present example was to evaluate glutamyl endopeptidase (having SEQ ID NO: 1) from *Bacillus lichenformis* ability of removing hair and providing fiber opening without damaging the grain in a modified beamhouse process where dehairing is concluded with a gradual increase in pH.

All percentages mentioned are on weight of hide/pelt.

Dirt Soak

Forty kg of salted Dutch black and white calf was soaked in 200% float (water) containing a biocide (0.01% Busan 30WB) at 20° C. in a tanning drum. After 1 hour the float solution was removed.

Modified Soak

200% fresh float (water) at 25° C. was added to the hides. A biocide (0.01% Busan 30WB) was added together with 13 mg enzyme protein/kg of hide of an alpha-amylase. The drum was rotated continuously for 4 hours. Then float solution was removed.

Dehairing

100% float (water) was added at 25° C. together with 0.3% Soda ash (or more to obtain pH 9.0-9.5) and Biocide (0.01% Busan30WB). The drum was rotated for 15 minutes to allow pH to adjust. Glutamyl endopeptidase from *Bacillus lichenformis* was added as 60 mg pure enzyme protein/kg of hide. The drum was rotated continuously for 2 hours. Hair loosening was observed already 1-1.5 hr after addition of the glutamyl endopeptidase. After 1.5 hrs the pH is gradually increased to >11 by gradually adding diluted NaOH.

After 3 hours in total the float was removed the hair was removed from the system and the pelts were sent for fleshing and splitting. The mechanical treatment removed most of the loose hair still sitting on the hides.

Liming

The pelts are returned to a float of 50% water at 25° C. together with 1.5% Sodium sulphide (65% in solid) and 2% slaked lime. The pelts were drummed continuously for 3 hours. For practical reasons the chemical treatment was continued overnight with the drum running 5 minutes every hour. The pelts, however, appeared to be free of hair already after the 3 hours, so in principle the liming could be stopped at this stage.

The pelts were then delimed, pickled and chrome tanned as described in Example 1.

The wet-blues were further processed to crust leather. Crust leather processing is well known to the person skilled in the art, one example of crust leather processing is described here.

All percentages mentioned are on weight of wet-blue (WB).

Washing

The wet-blue was washed in 300% water together with 0.2% formic acid diluted in 25%, resulting in a total float of 325%. The wash was performed 15 minutes at 30° C., and the float was discharged.

Re-Chroming

150% float water was added together with 3% inorganic tanning agent, such as BayChrome® FD (Lanxess, Germany) and run for 1½ hour. The float was drained and the wet-blues were wash 10 minutes with 200% water and drained.

Neutralization

A new float was established with 100% water together with a mixture of alkalizing agents like 2% of Syntan NN 555 (Smit&Zoon, Netherlands) together with 2% Sodium Formiate and run for 20 minutes. Then 1% Sodium Bicarbonate and 0.5% of Sulphirol WS (Smit&Zoon) which is a lanoline based fat liquor were added and the process was continued for 1½ hour.

The float was drained and a short wash with 200% water at 25° C. for 10 minutes was performed.

The process was continued with a new float of 70% water, 2% Relugan RE (BASF, Germany), a polymeric retaining agent, diluted with 25% water at 30° C. before addition to the float. This mixture, with a float volume of 95% was run for 20 minutes. Then a fatliquor such as 1.5% Synthol WP (Smit&Zoon) was added together with 1% polymer like Densotan A (BASF). The fatliquor and polymer was diluted in 25% water at 30° C. before addition to the float. The process with a float volume of 120% was continued for 20 minutes.

2% of a vegetable tanning agent like Quebracho is then added to the float together with organic fillers such as 5% Syntan LF 187 (Smit&Zoon) and 3% Syntan DF 585 (Smit&Zoon) and run for 15 minutes. Then adding 2% Tannigan PR (Lanxess), a synthetic retanning agent, and a desired amount of dye. After 1½ hours the float was drained.

Fatliquoring

A new float of 100% water at 60° C. was established with 5% Synthol DS (Smit&Zoon) and 2% Synthol WP (Smit&Zoon) together with 1% Syncotan TL (Smit&Zoon), a polyacrylic softener diluted together with 25% water at 60° C. before added to the float, resulting in a total float volume of 125%.

Fixation

After 1 hr and 10 min. diluted formic acid was added (1% formic acid in 5% water) at 38° C. Then after 30 minutes another dosage of same amount was added and again after 30 minutes another dosage was added but this time with only 0.5% formic acid. The drum was runs for 30 minutes before draining.

A wash with 250% water at 30° C. for 10 minutes was performed before the final fixation.

Which was done in 150% water at 35° C. this time with Chromium such as 3% Chromosal BD (Lanxess). It was run for 1½ hour before draining and washing.

Samples from neck, belly and butt from both halves of the crust leather obtained by this process was analyzed (12 samples in total) with respect to hair removal, fiber opening and grain damage as described in Example 3.

All the samples showed a very good level of hair removal, both visually on the grain and when the hair shafts and root were examined in section using light microscopy. The hair shafts and root had been totally removed on most of the examined samples.

The fiber opening was acceptable for the majority of the samples with exception of a two of the samples.

All of the samples showed some evidence of light grain damage. For two of samples there was evidence of more pronounced damage. This was expected due to variations in quality of the raw material. Visually the leather was given a high quality score.

From these results it can be seen that a really good hair removal can be obtained with enzyme doses of 60 mg enzyme protein/kg hide. This is a significant result, since conventional dehairing processes frequently leaves portions of undegraded hair behind in the follicles. Finally it can be seen that grain damage and fiber opening is acceptable.

Example 6

The purpose of the present example was to evaluate high dosage glutamyl endopeptidase (having SEQ ID NO: 1) from *Bacillus lichenformis* and the ability of removing hair and providing fiber opening without damaging the grain in a modified beamhouse process under production conditions where unhairing is concluded with addition of sulphide and lime. In this trial the pelt goes into the tannery standard production after splitting.

All percentages mentioned are on weight of hide/pelt.

Dirt Soak 10,228 kg of salted EU calf was washed two times in 2×200% float (water) at 27° C. in a wooden Valero drum. 20 minutes drumming each not including the time for filling and draining the drum.

Modified Soak

200% fresh float (water) at 27° C. was added to the hides. A biocide (0.15% Preventol ZL) was added together with 13 mg enzyme protein/kg of hide of an alpha-amylase. The drum was rotated continuously for 40 minutes (at 2 rpm). Then float solution was removed thoroughly down to remaining approximately 25%.

Combined Soak and Dehairing

On the remaining 25% float (27° C.) another 13 mg enzyme protein/kg of hide of an alpha-amylase was added together with the biocide (0.15% Preventol ZL). Drum rotating 30 minutes at 2 rpm. Then Glutamyl endopeptidase from *Bacillus lichenformis* was added as up to 165 mg pure enzyme protein/kg of hide. Running drum 60 minutes at 2 rpm hair filter system was started together with the drum. Then after the 60 minutes 0.1% caustic soda solution (50%) was added reaching pH 8.9 after 30 minutes. Then another dosage of 0.1% caustic soda was added reaching pH 9.5 after 30 minutes. Drumming 90 minutes to allow for high degree unhairing before more float (30%) was added (to improve filtration) and continuing 120 minutes. Inspecting hides after the two hours disclosed an estimated unhairing of >90%.

The drum was drained thoroughly (<30% 27 degr C.) and filter was disconnected. Then 1.3% $Na_2S$ (67%) powder was added to the pelts letting it burn the remaining hair for 30 minutes at 2 rpm. Then 1.3% $Ca(OH)_2$ was added. The drum was allowed to run 60 minutes hereafter 40% water was added and after 60 minutes another 30% water was added. The drum was then put on automatic overnight 1 rpm 5 min run/25 min pause. The following morning the drum was emptied and pelts were fleshed and split.

The pelts were then delimed, pickled and chrome tanned according to the standard recipes of the tannery.

After chrome tannage the 400 pcs of wet blue was inspected. All showed a very good level of hair removal without hair roots or shafts present.

Whole WB pieces from both enzyme and standard production were taken to pilot to be turned into three different articles of crust leather. A milled black shoe upper type, a soft semi vegetable type and a soft nubuck shoe upper type. Following tear strengths for the prepared articles were determined. The column "conclusion" indicated the overall evaluation of the produced crust articles:

TABLE 4

| Crust article | Thickness Average (mm) | Length tear strength (N) | Width tear strength (N) | conclusion |
|---|---|---|---|---|
| Soft Semi Veg Standard production | 1.4 | 68 | 71.8 | OK |
| Soft Semi Veg Enzyme production | 1.4 | 63 | 76.6 | OK |
| Lightblue nubuck Standard production | 1.4 | 100 | 104.4 | OK |
| Lightblue nubuck Enzyme production | 1.4 | 69 | 68.2 | OK |
| Milled Black Standard production | 1.1 | 41 | 40.0 | OK |
| Milled Black Enzyme production | 1.0 | 54 | 45.0 | OK |

From these results it can be seen that a very good hair removal was obtained using the enzyme production method and satisfactory crust articles were formed from the prepared hides.

Example 7

The purpose of the present example was to demonstrate the dehairing performance of four different glutamyl endopeptidases, two from *Bacillus licheniformis* (having SEQ ID NO: 1 or SEQ ID NO: 4), *Bacillus pumilus* JA96 (having SEQ ID NO: 2) and *Streptomyces griseus* (having SEQ ID NO: 8).

The glutamyl endopeptidases from *Bacillus licheniformis* having SEQ ID NO: 4 and from *Streptomyces griseus* were found to have glutamyl endopeptidase ratios of 420 and 65700 respectively, using the method disclosed in Example 1.

Salted Dutch cowhide were washed in cold tap water and cut into 20 mm by 300-600 mm pieces. The cowhide pieces were soaked in 250 mM glycine-NaOH buffer for 2 h. After this incubation, fat and tendons were removed from the cowhide pieces and the cowhide pieces were weighed. In each trial, eight different pieces of cowhide were enzymatically treated in two 500 ml Erlenmeyer flasks in 250 mM Glycine-NaOH buffer at 130 rpm, pH 9 and 26° C. for 20 h. *Bacillus licheniformis* (having SEQ ID NO: 1), *Bacillus licheniformis* (having SEQ ID NO: 4) *Bacillus pumilus* JA96 and *Streptomyces griseus* glutamyl endopeptidase were used in the study. The performance of each glutamyl endopeptidase was evaluated in three different experiments (i.e. 24 different pieces of cowhide were enzymatically treated in total). The negative control was treated in the same way but without enzyme addition. After 20 h of incubation, the dehairing efficiency was assessed by using spring scales (60, 600 and 2500 g, Kern & Sohn, GmbH, D-72336, Ballinge). The cowhide pieces were mounted on test plates and 5 mm by 10 mm of hair from the cowhide pieces were fastened by using a hair clip. The spring-scale was then connected to the fixated hair clip and pulled upwards. The dehairing efficiency was measured in grams and the required deharing force was calculated by multiplying the measured weight (in kg) with 9.81 $m/s^2$.

The deharing properties of *Bacillus licheniformis* (having SEQ ID NO: 1), *Bacillus licheniformis* (having SEQ ID NO: 4) *Bacillus pumilus* JA96 and *Streptomyces griseus* glutamyl endopeptidase are shown in Table 5. The negative control required a significantly higher deharing force (13 N) than the enzymatically treated cowhide pieces (0.5-0.8 N) (Table 5). Complete hair removal was achieved with the glutamyl endopeptidase treated cowhide pieces whereas hair of the negative control often broke when the appropriate force was applied. A higher enzyme dosage of *Streptomyces griseus* glutamyl endopeptidase was required in order to reach the same dehairing effect as the *Bacillus licheniformis* (having SEQ ID NO: 1), *Bacillus licheniformis* (having SEQ ID NO: 4) and *Bacillus pumilus* JA96 glutamyl endopeptidase (Table 5).

TABLE 5

Dehairing efficiency of glutamyl endopeptidase treated cowhide pieces. The Table shows the mean values from three different experiments (i.e. mean value from 24 pieces of cowhide). The deharing forces are given in Newton.

| GLUTAMYL ENDOPEPTIDASE | ENZYME DOSAGE (MG EP/KG HIDE) | DEHARING FORCE (N) |
|---|---|---|
| NEGATIVE CONTROL | 0 | 13 |
| *BACILLUS LICHENIFORMIS* (SEQ ID NO: 1) | 50 | 0.8 |
| *STREPTOMYCES GRISEUS* (SEQ ID NO: 8) | 500 | 0.5 |
| *BACILLUS LICHENIFORMIS* (SEQ ID NO: 4) | 50 | 0.8 |
| *BACILLUS PUMILUS* JA96 (SEQ ID NO: 2) | 50 | 0.8 |

SEQUENCE LISTING

```
<160> NUMBER OF SEQ ID NOS: 8

<210> SEQ ID NO 1
<211> LENGTH: 316
<212> TYPE: PRT
<213> ORGANISM: Bacillus licheniformis

<400> SEQUENCE: 1

Met Val Ser Lys Lys Ser Val Lys Arg Gly Leu Ile Thr Gly Leu Ile
1               5                   10                  15

Gly Ile Ser Ile Tyr Ser Leu Gly Met His Pro Ala Gln Ala Ala Pro
            20                  25                  30

Ser Pro His Thr Pro Val Ser Ser Asp Pro Ser Tyr Lys Ala Glu Thr
        35                  40                  45

Ser Val Thr Tyr Asp Pro Asn Ile Lys Ser Asp Gln Tyr Gly Leu Tyr
    50                  55                  60

Ser Lys Ala Phe Thr Gly Thr Gly Lys Val Asn Glu Thr Lys Glu Lys
65                  70                  75                  80

Ala Glu Lys Lys Ser Pro Ala Lys Ala Pro Tyr Ser Ile Lys Ser Val
                85                  90                  95

Ile Gly Ser Asp Asp Arg Thr Arg Val Thr Asn Thr Thr Ala Tyr Pro
            100                 105                 110

Tyr Arg Ala Ile Val His Ile Ser Ser Ser Ile Gly Ser Cys Thr Gly
        115                 120                 125

Trp Met Ile Gly Pro Lys Thr Val Ala Thr Ala Gly His Cys Ile Tyr
    130                 135                 140

Asp Thr Ser Ser Gly Ser Phe Ala Gly Thr Ala Thr Val Ser Pro Gly
145                 150                 155                 160

Arg Asn Gly Thr Ser Tyr Pro Tyr Gly Ser Val Lys Ser Thr Arg Tyr
```

```
                165                 170                 175

Phe Ile Pro Ser Gly Trp Arg Ser Gly Asn Thr Asn Tyr Asp Tyr Gly
            180                 185                 190

Ala Ile Glu Leu Ser Glu Pro Ile Gly Asn Thr Val Gly Tyr Phe Gly
        195                 200                 205

Tyr Ser Tyr Thr Thr Ser Ser Leu Val Gly Thr Thr Val Thr Ile Ser
    210                 215                 220

Gly Tyr Pro Gly Asp Lys Thr Ala Gly Thr Gln Trp Gln His Ser Gly
225                 230                 235                 240

Pro Ile Ala Ile Ser Glu Thr Tyr Lys Leu Gln Tyr Ala Met Asp Thr
                245                 250                 255

Tyr Gly Gly Gln Ser Gly Ser Pro Val Phe Glu Gln Ser Ser Ser Arg
            260                 265                 270

Thr Asn Cys Ser Gly Pro Cys Ser Leu Ala Val His Thr Asn Gly Val
        275                 280                 285

Tyr Gly Gly Ser Ser Tyr Asn Arg Gly Thr Arg Ile Thr Lys Glu Val
    290                 295                 300

Phe Asp Asn Leu Thr Asn Trp Lys Asn Ser Ala Gln
305                 310                 315


<210> SEQ ID NO 2
<211> LENGTH: 303
<212> TYPE: PRT
<213> ORGANISM: Bacillus pumilus

<400> SEQUENCE: 2

Met Met Lys Lys Met Lys Lys Leu Ile Pro Ser Leu Leu Val Phe Gly
1               5                   10                  15

Ala Leu Ser Val Pro Ser Phe Ala His Ala Ala Ser Asp Ser Val Leu
            20                  25                  30

Thr Ser Asp Tyr Asp Met Val Thr Ser Asp Gly Lys Val Ile Ser Ser
        35                  40                  45

Ala Asp Phe His Asn Asp Met Lys Thr Pro Ser Ser Phe Asp Lys Val
    50                  55                  60

Asp Asp Leu Ser Ser Thr Ile Gly Glu Lys Val Lys Pro Leu Thr Thr
65                  70                  75                  80

Tyr Leu Lys Asp Phe Gln Thr Lys Val Val Ile Gly Asp Asp Gly Arg
                85                  90                  95

Thr Lys Val Thr Asn Thr Arg Val Ala Pro Tyr Asn Ser Ile Ala Tyr
            100                 105                 110

Ile Thr Phe Gly Gly Ser Ser Cys Thr Gly Thr Leu Ile Ala Pro Asn
        115                 120                 125

Lys Ile Leu Thr Asn Gly His Cys Val Tyr Asn Thr Ala Thr Arg Ser
    130                 135                 140

Tyr Ser Ala Lys Gly Ser Val Tyr Pro Gly Met Asn Asp Ser Thr Ala
145                 150                 155                 160

Val Asn Gly Ser Ala Asn Met Thr Glu Phe Tyr Val Pro Ser Gly Tyr
                165                 170                 175

Ile Asn Thr Gly Ala Ser Gln Tyr Asp Phe Ala Val Ile Lys Thr Asp
            180                 185                 190

Thr Asn Ile Gly Asn Thr Val Gly Tyr Arg Ser Ile Arg Gln Val Thr
        195                 200                 205

Asn Leu Thr Gly Thr Thr Ile Lys Ile Ser Gly Tyr Pro Gly Asp Lys
    210                 215                 220
```

```
Met Arg Ser Thr Gly Lys Val Ser Gln Trp Glu Met Ser Gly Pro Val
225                 230                 235                 240

Thr Arg Glu Asp Thr Asn Leu Ala Tyr Tyr Thr Ile Asp Thr Phe Ser
                245                 250                 255

Gly Asn Ser Gly Ser Ala Met Leu Asp Gln Asn Gln Gln Ile Val Gly
            260                 265                 270

Val His Asn Ala Gly Tyr Ser Asn Gly Thr Ile Asn Gly Gly Pro Lys
        275                 280                 285

Ala Thr Ala Ala Phe Val Glu Phe Ile Asn Tyr Ala Lys Ala Gln
    290                 295                 300


<210> SEQ ID NO 3
<211> LENGTH: 313
<212> TYPE: PRT
<213> ORGANISM: Bacillus subtilis

<400> SEQUENCE: 3

Met Lys Leu Val Pro Arg Phe Arg Lys Gln Trp Phe Ala Tyr Leu Thr
1               5                   10                  15

Val Leu Cys Leu Ala Leu Ala Ala Ala Val Ser Phe Gly Val Pro Ala
            20                  25                  30

Lys Ala Ala Glu Asn Pro Gln Thr Ser Val Ser Asn Thr Gly Lys Glu
        35                  40                  45

Ala Asp Ala Thr Lys Asn Gln Thr Ser Lys Ala Asp Gln Val Ser Ala
    50                  55                  60

Pro Tyr Glu Gly Thr Gly Lys Thr Ser Lys Ser Leu Tyr Gly Gly Gln
65                  70                  75                  80

Thr Glu Leu Glu Lys Asn Ile Gln Thr Leu Gln Pro Ser Ser Ile Ile
                85                  90                  95

Gly Thr Asp Glu Arg Thr Arg Ile Ser Ser Thr Thr Ser Phe Pro Tyr
            100                 105                 110

Arg Ala Thr Val Gln Leu Ser Ile Lys Tyr Pro Asn Thr Ser Ser Thr
        115                 120                 125

Tyr Gly Cys Thr Gly Phe Leu Val Asn Pro Asn Thr Val Val Thr Ala
    130                 135                 140

Gly His Cys Val Tyr Ser Gln Asp His Gly Trp Ala Ser Thr Ile Thr
145                 150                 155                 160

Ala Ala Pro Gly Arg Asn Gly Ser Ser Tyr Pro Tyr Gly Thr Tyr Ser
                165                 170                 175

Gly Thr Met Phe Tyr Ser Val Lys Gly Trp Thr Glu Ser Lys Asp Thr
            180                 185                 190

Asn Tyr Asp Tyr Gly Ala Ile Lys Leu Asn Gly Ser Pro Gly Asn Thr
        195                 200                 205

Val Gly Trp Tyr Gly Tyr Arg Thr Thr Asn Ser Ser Ser Pro Val Gly
    210                 215                 220

Leu Ser Ser Ser Val Thr Gly Phe Pro Cys Asp Lys Thr Phe Gly Thr
225                 230                 235                 240

Met Trp Ser Asp Thr Lys Pro Ile Arg Ser Ala Glu Thr Tyr Lys Leu
                245                 250                 255

Thr Tyr Thr Thr Asp Thr Tyr Gly Cys Gln Ser Gly Ser Pro Val Tyr
            260                 265                 270

Arg Asn Tyr Ser Asp Thr Gly Gln Thr Ala Ile Ala Ile His Thr Asn
        275                 280                 285

Gly Gly Ser Ser Tyr Asn Leu Gly Thr Arg Val Thr Asn Asp Val Phe
    290                 295                 300
```

```
Asn Asn Ile Gln Tyr Trp Ala Asn Gln
305                 310


<210> SEQ ID NO 4
<211> LENGTH: 314
<212> TYPE: PRT
<213> ORGANISM: Bacillus licheniformis

<400> SEQUENCE: 4

Met Ala Lys Asn Gly Val Ser Arg Val Phe Ile Ala Gly Leu Ile Gly
1               5                   10                  15

Ile Ser Ile Phe Ser Ser Gly Ile Tyr Ser Ala Gln Ala Ala Ser Ser
            20                  25                  30

Pro His Thr Pro Val Ser Ser Asp Pro Ser Tyr Lys Pro Gly Ser Thr
        35                  40                  45

Tyr Asp Pro Asn Ile Lys Ile Asp Asn Asn Gly Ala Tyr Ser Lys Ala
    50                  55                  60

Phe Glu Gly Thr Gly Thr Pro Gly Gly Ser Val Gln Ala Lys Pro Lys
65                  70                  75                  80

Lys Glu Ser Pro Ala Gly Pro Pro Tyr Ser Pro Lys Ser Val Ile Gly
                85                  90                  95

Ser Asp Glu Arg Thr Arg Val Thr Asp Thr Thr Ala Phe Pro Tyr Arg
            100                 105                 110

Ala Ile Val His Ile Ser Ser Ser Ile Gly Ser Cys Thr Gly Trp Leu
        115                 120                 125

Ile Gly Pro Lys Thr Val Ala Thr Ala Gly His Cys Val Tyr Asp Thr
    130                 135                 140

Ala Ser Arg Ser Phe Ala Gly Thr Ala Thr Val Ser Pro Gly Arg Asn
145                 150                 155                 160

Gly Ser Ala Tyr Pro Tyr Gly Ser Val Thr Ser Thr Arg Tyr Phe Ile
                165                 170                 175

Pro Ser Gly Trp Gln Ser Gly Asn Ser Asn Tyr Asp Tyr Ala Ala Ile
            180                 185                 190

Glu Leu Ser Gln Pro Ile Gly Asn Thr Val Gly Tyr Phe Gly Tyr Ser
        195                 200                 205

Tyr Thr Ala Ser Ser Leu Ala Gly Ala Gly Val Thr Ile Ser Gly Tyr
    210                 215                 220

Pro Gly Asp Lys Thr Thr Gly Thr Gln Trp Gln Met Ser Gly Thr Ile
225                 230                 235                 240

Ala Val Ser Glu Thr Tyr Lys Leu Gln Tyr Ala Ile Asp Thr Tyr Gly
                245                 250                 255

Gly Gln Ser Gly Ser Pro Val Tyr Glu Lys Ser Ser Ser Arg Thr Asn
            260                 265                 270

Cys Ser Gly Pro Cys Ser Leu Ala Val His Thr Asn Gly Val Tyr Gly
        275                 280                 285

Gly Ser Ser Tyr Asn Arg Gly Thr Arg Ile Thr Lys Glu Val Phe Asp
    290                 295                 300

Asn Phe Thr Ser Trp Lys Asn Ser Ala Gln
305                 310


<210> SEQ ID NO 5
<211> LENGTH: 336
<212> TYPE: PRT
<213> ORGANISM: Staphylococcus aureus

<400> SEQUENCE: 5
```

```
Met Lys Gly Lys Phe Leu Lys Val Ser Ser Leu Phe Val Ala Thr Leu
1               5                   10                  15

Thr Thr Ala Thr Leu Val Ser Ser Pro Ala Ala Asn Ala Leu Ser Ser
            20                  25                  30

Lys Ala Met Asp Asn His Pro Gln Gln Thr Gln Ser Ser Lys Gln Gln
        35                  40                  45

Thr Pro Lys Ile Gln Lys Gly Gly Asn Leu Lys Pro Leu Glu Gln Arg
    50                  55                  60

Glu His Ala Asn Val Ile Leu Pro Asn Asn Asp Arg His Gln Ile Thr
65                  70                  75                  80

Asp Thr Thr Asn Gly His Tyr Ala Pro Val Thr Tyr Ile Gln Val Glu
                85                  90                  95

Ala Pro Thr Gly Thr Phe Ile Ala Ser Gly Val Val Val Gly Lys Asp
            100                 105                 110

Thr Leu Leu Thr Asn Lys His Val Val Asp Ala Thr His Gly Asp Pro
        115                 120                 125

His Ala Leu Lys Ala Phe Pro Ser Ala Ile Asn Gln Asp Asn Tyr Pro
    130                 135                 140

Asn Gly Gly Phe Thr Ala Glu Gln Ile Thr Lys Tyr Ser Gly Glu Gly
145                 150                 155                 160

Asp Leu Ala Ile Val Lys Phe Ser Pro Asn Glu Gln Asn Lys His Ile
                165                 170                 175

Gly Glu Val Val Lys Pro Ala Thr Met Ser Asn Asn Ala Glu Thr Gln
            180                 185                 190

Val Asn Gln Asn Ile Thr Val Thr Gly Tyr Pro Gly Asp Lys Pro Val
        195                 200                 205

Ala Thr Met Trp Glu Ser Lys Gly Lys Ile Thr Tyr Leu Lys Gly Glu
    210                 215                 220

Ala Met Gln Tyr Asp Leu Ser Thr Thr Gly Gly Asn Ser Gly Ser Pro
225                 230                 235                 240

Val Phe Asn Glu Lys Asn Glu Val Ile Gly Ile His Trp Gly Gly Val
                245                 250                 255

Pro Asn Glu Phe Asn Gly Ala Val Phe Ile Asn Glu Asn Val Arg Asn
            260                 265                 270

Phe Leu Lys Gln Asn Ile Glu Asp Ile His Phe Ala Asn Asp Asp Gln
        275                 280                 285

Pro Asn Asn Pro Asp Asn Pro Asp Asn Pro Asn Asn Pro Asp Asn Pro
    290                 295                 300

Asn Asn Pro Asp Glu Pro Asn Asn Pro Asp Asn Pro Asn Asn Pro Asp
305                 310                 315                 320

Asn Pro Asp Asn Gly Asp Asn Asn Asn Ser Asp Asn Pro Asp Ala Ala
                325                 330                 335


<210> SEQ ID NO 6
<211> LENGTH: 342
<212> TYPE: PRT
<213> ORGANISM: Bacillus horikoshii

<400> SEQUENCE: 6

Met Lys Leu Leu Leu Lys Leu Thr Phe Val Cys Ile Phe Met Leu Ser
1               5                   10                  15

Gly Ile Leu Ser Pro Val Asn Ala Thr Gln Ala Glu Thr Leu Thr Lys
            20                  25                  30

Leu Asn Lys Ile Ser Gln Lys Gln Glu Pro Ser Tyr Lys Leu Asp Glu
```

```
        35                  40                  45

Glu Met Asp Tyr Val Leu Ile Asp Leu Glu Thr Gln Ser Glu Ser Ile
    50                  55                  60

Ile Ser Ile Gly Asp Asn Thr Asp Leu Gly Asp Gln Ser Phe Thr Ser
65                  70                  75                  80

Leu Gly Lys Val Gly His Gly Glu Leu Glu Lys Ile Asn Leu Glu Glu
                85                  90                  95

Phe Arg Asn Pro Asn Leu Thr Val Val Asp Pro Leu Thr Arg Lys Pro
            100                 105                 110

Ile Glu Gln Lys Ile Ser Pro Phe Val Val Ile Gly Asp Asp Gly Arg
        115                 120                 125

Arg Gln Val Gln Asn Thr Ser Phe Met Pro Phe Arg Ala Leu Thr Tyr
    130                 135                 140

Ile Glu Phe Gly Asn Leu Thr Ser Thr Trp Ser Cys Ser Gly Gly Val
145                 150                 155                 160

Ile Gly Thr Asp Leu Val Val Thr Asn Ala His Cys Val Glu Gly Ser
                165                 170                 175

Val Leu Ala Gly Thr Val Val Pro Gly Met Asn Asn Ser Gln Trp Ala
            180                 185                 190

Tyr Gly His Tyr Arg Val Thr Gln Ile Ile Tyr Pro Asp Gln Tyr Arg
        195                 200                 205

Asn Asn Gly Ala Ser Glu Phe Asp Tyr Ala Ile Leu Arg Val Ala Pro
    210                 215                 220

Asp Ser Asp Gly Arg His Ile Gly Asn Arg Ala Gly Ile Leu Ser Phe
225                 230                 235                 240

Thr Glu Thr Gly Thr Val Asn Glu Asn Thr Phe Leu Arg Thr Tyr Gly
                245                 250                 255

Tyr Pro Gly Asp Lys Ile Ser Glu Thr Lys Leu Ile Ser Leu Trp Gly
            260                 265                 270

Met Val Gly Arg Ser Asp Ala Phe Leu His Arg Asp Leu Leu Phe Tyr
        275                 280                 285

Asn Met Asp Thr Tyr Phe Gly Gln Ser Gly Ser Pro Val Leu Asn Ser
    290                 295                 300

Val Asp Ser Met Val Ala Val His Asn Ala Gly Tyr Ile Val Gly Gly
305                 310                 315                 320

Asn Arg Glu Ile Asn Gly Gly Pro Lys Ile Arg Arg Asp Phe Thr Asn
                325                 330                 335

Leu Phe Asn Gln Met Asn
            340


<210> SEQ ID NO 7
<211> LENGTH: 318
<212> TYPE: PRT
<213> ORGANISM: Bacillus licheniformis

<400> SEQUENCE: 7

Met Lys Lys Ser Val Thr Arg Val Leu Met Ala Gly Leu Ile Gly Ile
1               5                   10                  15

Ser Ile Tyr Ser Met Gly Ile Asp Ser Ala Gln Ala Ala Ser Ser Pro
            20                  25                  30

His Thr Pro Val Ser Ser Asp Pro Ser Tyr Lys Pro Asp Ser Ser Ala
        35                  40                  45

Ser Tyr Asp Pro Ala Ile Lys Thr Asn Lys Asn Gly Ala Tyr Ser Lys
    50                  55                  60
```

```
Ala Phe Glu Gly Thr Gly Lys Leu Asp Ala Pro Leu Tyr Gln Glu Lys
65                  70                  75                  80

Ser Lys Pro Thr Lys Lys Ser Pro Ala Gly Pro Arg Tyr Ser Pro Lys
                85                  90                  95

Ser Val Ile Gly Ser Asp Glu Arg Thr Arg Val Thr Asn Thr Thr Ala
            100                 105                 110

Tyr Pro Tyr Arg Ala Ile Val His Ile Ser Ser Ser Ile Gly Ser Cys
        115                 120                 125

Thr Gly Ser Leu Ile Gly Pro Lys Thr Val Ala Thr Ala Gly His Cys
    130                 135                 140

Ile Tyr Asp Thr Ala Ser Gly Ser Phe Ala Gly Thr Ala Thr Val Ser
145                 150                 155                 160

Pro Gly Arg Asn Gly Ser Thr Tyr Pro Tyr Gly Ser Val Thr Ser Thr
                165                 170                 175

Arg Tyr Phe Ile Pro Ser Gly Tyr Arg Ser Gly Asn Ser Asn Tyr Asp
            180                 185                 190

Tyr Gly Ala Ile Glu Leu Ser Gln Pro Ile Gly Asn Thr Val Gly Tyr
        195                 200                 205

Phe Gly Tyr Ser Tyr Thr Thr Ser Ser Leu Val Gly Ser Ser Val Thr
    210                 215                 220

Ile Ile Gly Tyr Pro Gly Asp Lys Thr Ser Gly Thr Gln Trp Gln Met
225                 230                 235                 240

Ser Gly Asn Ile Ala Val Ser Glu Thr Tyr Lys Leu Gln Tyr Ala Ile
                245                 250                 255

Asp Thr Tyr Gly Gly Gln Ser Gly Ser Pro Val Tyr Glu Ala Ser Ser
            260                 265                 270

Ser Arg Thr Asn Cys Ser Gly Pro Cys Ser Leu Ala Val His Thr Asn
        275                 280                 285

Gly Val Tyr Gly Gly Ser Ser Tyr Asn Arg Gly Thr Arg Ile Thr Lys
    290                 295                 300

Glu Val Phe Asp Asn Leu Thr Asn Trp Lys Asn Ser Ala Gln
305                 310                 315


<210> SEQ ID NO 8
<211> LENGTH: 355
<212> TYPE: PRT
<213> ORGANISM: Streptomyces griseus

<400> SEQUENCE: 8

Met Arg Arg Asn Ser Arg Ala Arg Leu Gly Val Ser Leu Leu Leu Val
1               5                   10                  15

Ala Gly Ala Leu Gly Leu Gly Ala Ala Pro Ser Thr Ala Ala Asp Thr
            20                  25                  30

Pro Pro Ala Ala Pro Ser Ala Ile Pro Ala Pro Ser Ala Tyr Ala Leu
        35                  40                  45

Asp Ala Ala Val Glu Arg Gln Leu Gly Ala Ala Thr Ala Gly Thr Tyr
    50                  55                  60

Leu Asp Ala Lys Thr Gly Gly Leu Val Val Thr Val Thr Thr Asp Arg
65                  70                  75                  80

Ala Glu Glu Gln Ala Arg Ala Ala Gly Ala Thr Val Arg Arg Val Ala
                85                  90                  95

Arg Ser Ala Ala Gln Leu Asp Ala Ala Met Ala Thr Leu Glu Ala Glu
            100                 105                 110

Ala Lys Ile Thr Gly Thr Ser Trp Gly Val Asp Pro Arg Thr Asn Arg
        115                 120                 125
```

-continued

```
Val Ala Val Glu Ala Asp Ser Ser Val Ser Ala Arg Asp Met Ala Arg
    130                 135                 140

Leu Glu Ala Val Ala Glu Arg Leu Gly Ser Ala Val Asp Ile Lys Arg
145                 150                 155                 160

Val Pro Gly Val Phe His Arg Glu Val Leu Gly Gly Gly Ala Ile Tyr
                165                 170                 175

Gly Gly Gly Ser Arg Cys Ser Ala Ala Phe Asn Val Thr Lys Gly Gly
            180                 185                 190

Ala Arg Tyr Phe Val Thr Ala Gly His Cys Thr Asn Ile Ser Ala Asn
        195                 200                 205

Trp Ser Ala Ser Ser Gly Gly Ser Val Val Gly Val Arg Glu Gly Thr
    210                 215                 220

Ser Phe Pro Thr Asn Asp Tyr Gly Ile Val Arg Tyr Thr Asp Gly Ser
225                 230                 235                 240

Ser Pro Ala Gly Thr Val Asp Leu Tyr Asn Gly Ser Thr Gln Asp Ile
                245                 250                 255

Ser Ser Ala Ala Asn Ala Val Val Gly Gln Ala Ile Lys Lys Ser Gly
            260                 265                 270

Ser Thr Thr Lys Val Thr Ser Gly Thr Val Thr Ala Val Asn Val Thr
        275                 280                 285

Val Asn Tyr Gly Asp Gly Pro Val Tyr Asn Met Val Arg Thr Thr Ala
    290                 295                 300

Cys Ser Ala Gly Gly Asp Ser Gly Gly Ala His Phe Ala Gly Ser Val
305                 310                 315                 320

Ala Leu Gly Ile His Ser Gly Ser Ser Gly Cys Ser Gly Thr Ala Gly
                325                 330                 335

Ser Ala Ile His Gln Pro Val Thr Glu Ala Leu Ser Ala Tyr Gly Val
            340                 345                 350

Thr Val Tyr
        355
```

The invention claimed is:

1. A method for loosening hairs on hides or skins comprising treating the hides or skins with a bacterial glutamyl endopeptidase, in an amount in the range of 40 to 500 mg pure enzyme protein/kg of hide or skin, in an aqueous solution having a pH in the range of 7 to 10, wherein the glutamyl endopeptidase is a serine endopeptidase that cleaves on the carboxy-terminal side of a glutamic acid residue and has a glutamyl endopeptidase ratio of at least 10.

2. The method of claim 1, wherein the pH of the aqueous solution is in the range of 7 to 10.

3. The method of claim 1, wherein the glutamyl endopeptidase treatment is performed at a pH in the range of 7 to 10, followed by a gradual increase in pH to above 11.

4. The method of claim 3, wherein the pH is increased gradually for 2 to 3.5 hours.

5. The method of claim 4, wherein the pH is increased gradually for 2.5 to 3.5 hours.

6. The method of claim 1, wherein the treatment is performed between 1 and 5 hours.

7. The method of claim 1, wherein the treatment is performed at a temperature in the range of 15-30° C.

8. The method of claim 1, further comprising treating the hides or skins with a second protease.

9. The method of claim 8, wherein the second protease is a serine protease.

10. The method of claim 8, wherein the second protease is selected from the group consisting of trypsin, trypsin-like protease, chymotrypsin and subtilisin.

11. The method of claim 1, wherein the glutamyl endopeptidase is the sole source of protease activity during the treatment.

12. The method of claim 1, wherein the glutamyl endopeptidase is derived from *Bacillus*.

13. The method of claim 1, wherein the glutamyl endopeptidase has at least 60% sequence identity to the mature polypeptide of one of SEQ ID NO: 1, 2, 3, 4, 5, 6, 7 or 8.

14. The method of claim 1, wherein the treatment is carried out in connection with mechanical action.

15. The method of claim 14, wherein the mechanical action is performed using a paddle, drum or mixer.

* * * * *

UNITED STATES PATENT AND TRADEMARK OFFICE

CERTIFICATE OF CORRECTION

PATENT NO. : 9,267,182 B2
APPLICATION NO. : 13/702567
DATED : February 23, 2016
INVENTOR(S) : Soerensen et al.

It is certified that error appears in the above-identified patent and that said Letters Patent is hereby corrected as shown below:

On the Title page, item (86), please delete "PCT/EO2011/060395" and insert --PCT/EP2011/060395--.

Signed and Sealed this
Second Day of August, 2016

Michelle K. Lee

Michelle K. Lee
*Director of the United States Patent and Trademark Office*